US007354043B2

(12) United States Patent
McGinniss

(10) Patent No.: US 7,354,043 B2
(45) Date of Patent: Apr. 8, 2008

(54) MOSAIC PLAYING-CARDS

(76) Inventor: Peter J. McGinniss, 8066 Tennyson Dr., Tallahassee, FL (US) 32309

( * ) Notice: Subject to any disclaimer, the term of this patent is extended or adjusted under 35 U.S.C. 154(b) by 156 days.

(21) Appl. No.: 10/909,143

(22) Filed: Jul. 30, 2004

(65) Prior Publication Data

US 2006/0022408 A1 Feb. 2, 2006

(51) Int. Cl.
*A63F 1/00* (2006.01)

(52) U.S. Cl. ..... 273/293; 273/292; 273/296; 273/299; 273/157 R; D21/376

(58) Field of Classification Search ..... 273/275, 273/276, 157 R, 292, 303, 304, 305, 293, 273/296, 299; D21/376
See application file for complete search history.

(56) References Cited

U.S. PATENT DOCUMENTS 191,167 A 5/1877 Mueller
869,302 A * 10/1907 Healy ..... 273/303
1,973,564 A 9/1934 Graham
2,571,195 A 10/1951 Buck
RE25,031 E * 8/1961 Hoolim ..... 434/96
3,643,956 A 2/1972 Bovasso
3,755,923 A 9/1973 Krahn
4,673,185 A 6/1987 Morley, Jr.
5,037,110 A 8/1991 Haskel
5,524,898 A 6/1996 Pavlovic
5,887,873 A 3/1999 Freeman
6,305,688 B1 10/2001 Waroway

* cited by examiner

*Primary Examiner*—Benjamin Layno
(74) *Attorney, Agent, or Firm*—John Wiley Horton

(57) ABSTRACT

A new gaming tool and method of game play including an unconventional deck of playing-cards not employing symbolic relations, but rather employing actual relations between rectilinear geometric regions. The playing-cards preferably employ geometric interactions of reflection, complementarity, contrariety, and identity. Geometric card properties that further enhance game play include figure-ground reversibility, handedness, rotational transformation, and perpendicular association. Indexing indicia are optionally provided so that the user can easily visualize the rectilinear geometric regions on a playing card by looking at only the corner of the card.

41 Claims, 20 Drawing Sheets

MOSAIC PLAYING-CARDS

BACKGROUND OF THE INVENTION

1. Background—Field of the Invention

This invention relates to amusement devices, more specifically card or tile games in which contest elements are intended to interact with each other in a competitive and amusing contest of skill and/or chance, according to definite rules.

2. Background—Prior Art

Competitive play is one of mankind's favorite endeavors. A deck of playing-cards is almost certainly the most popular gaming tool of all time.

Playing-cards are unique in the subclass of card or game tiles. Unlike specific game pieces, the appeal of playing-cards is the wide variety of games that can be played simply by redefining the rules (playing a different game). A multi-dimensional system of relations between cards, and various subsets of cards, is essential to the versatility of a successful deck of playing-cards.

The success of a deck of playing-cards, as a gaming tool, is also due in no small way to its ergonomic physical attributes. Cards are portable and inexpensive. Opaque construction provides the security needed for competitive game play. The conventional rectangular shape facilitates shuffling the deck, a function that is essential in playing card games.

While many unique decks of playing-cards exist, the state of the art is overwhelmingly emblematic, employing symbolic marks on the card's playing face. The multiplicity of games that can be developed is based upon, and limited by, the relations of the various symbols.

The most popular deck of playing-cards is related as a simple matrix consisting of a hierarchical sequence with the addition of suit modifiers. The readily apparent relations promote game development. Indeed the vast majority of games are based upon collecting card subsets of similar rank, or similar suit, or in a hierarchical sequence. In Poker games, these subsets would be called: multiples of a kind, flushes and straights.

| | A | 2 | 3 | 4 | 5 | 6 | 7 | 8 | 9 | 10 | J | Q | K |
|---|---|---|---|---|---|---|---|---|---|---|---|---|---|
| ♥ | A♥ | | | | | | | 8♥ | | | | | |
| ♣ | A♣ | | 3♣ | 4♣ | 5♣ | | | | 9♣ | | | | |
| ♦ | A♦ | | | | | | | | | 10♦ | | | |
| ♥ | | | | | | | | | | | J♥ | | |

There are of course limits to the symbolic relations in this simple matrix. A deck of playing-cards having playing faces that are subdivided into geometric regions, or play-fields, would allow for geometric relations in a physical or non-symbolic manner. Thus, such a deck would provide the opportunity for new and unique games that are not possible with decks of emblematic playing-cards.

Cultural bias can be observed in many of the symbols employed in emblematic playing-cards. Corner indicia of the popular English playing-cards employ numeric symbols that are foreign to non-English speaking peoples. Symbols of the English Royalty and the superiority of King over Queen could be offensive to some and foreign to others. Similar cultural symbols can be observed in emblematic playing-cards around the world.

In today's highly communicative world, the cultural bias of conventional emblematic playing-cards limits the opportunity for cross-cultural play. By contrast, games that employ the more fundamental and universal concepts of geometric shapes and relations are trans-cultural and timeless. Geometric playing-cards provide the opportunity for truly global game play.

The vast majority of geometric game pieces have previously been developed for specific limited uses such as puzzles, path-forming games, edge matching games, or board games. However, examples of a well-developed system of non-emblematic geometric cards that are capable of functioning as a multi-dimensional playing card gaming tool are absent from the art.

Also absent from the art are cards that combine the basic physical attributes of conventional playing cards with a well-understood and versatile system of rectilinear geometric relations between the cards.

Geometric game pieces with indexing corner indicia (a miniature depiction which informs the user of all the card's relevant attributes) are absent from the prior art. Indexing indicia provide a method of viewing the properties of the cards while handheld in a compact, convenient, and secure manner necessary to facilitate popular types of handheld set collection games like Poker or Rummy. Previous geometric game pieces have not been designed to employ such conventional handheld methods of playing-card play, as evidenced by the lack of these indexing indicia. Further, examples of cards that employ rectilinear geometric relations and include suits and cross-suit relations that are used in many conventional set collection games, are also absent from the art.

While the physical characteristics of conventional playing-cards enable popular hand-held methods of game play, the well understood and versatile system of relations between the cards is the factor which actually allows an extremely varied array of games to be played. Some such potential might impliedly exist within the previously known geometric playing cards, but this potential is unrealized as the prior disclosures for such geometric cards do not adequately describe the use of geometric relations.

SUMMARY

The present invention comprises a deck of playing cards (or comparable game pieces, whether in physical or electronic form) of conventional construction, but having playing faces subdivided into rectilinear geometric regions, or play-fields. The rectilinear geometric regions are positioned so that a plurality of cards can be collected or arranged to synthesize larger and more complex geometric sets, sequences, shapes, or patterns.

The deck is designed to facilitate conventional methods of playing-card play, which have previously only been used for emblematic cards. Each card preferably includes a small indexing indicia, which comprises a miniature depiction of the rectilinear geometric regions on the entire playing face. These indexing indicia allow a user to hold a "hand" of such cards in a fanned fashion, while still being able to visualize the appearance of each card.

Several embodiments are disclosed, focusing on different types of rectilinear geometry. Some embodiments feature multiple suits defined by differing colors of the rectilinear geometric regions. Cross-suit play is made possible by the arrangement of the geometry. A plethora of games can be defined using the card deck. Examples of some of these games are provided.

DRAWINGS

Figure 5:
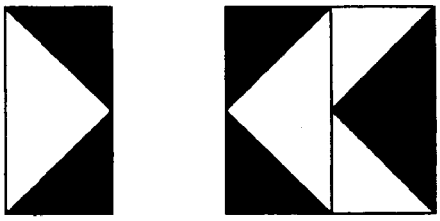
Figure 6:
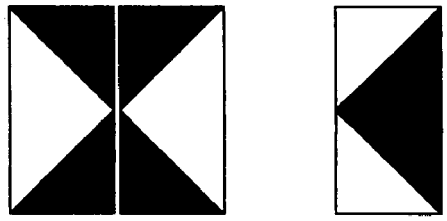

FIGS. 5 & 6 demonstrate reversible figure and ground association of a card.

Figure 7:
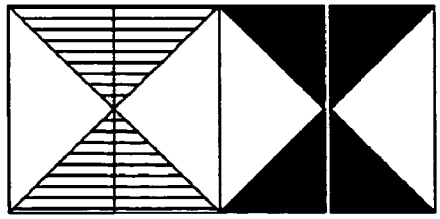

FIG. 7 demonstrates cross suit association by common ground color.

Figure 8:
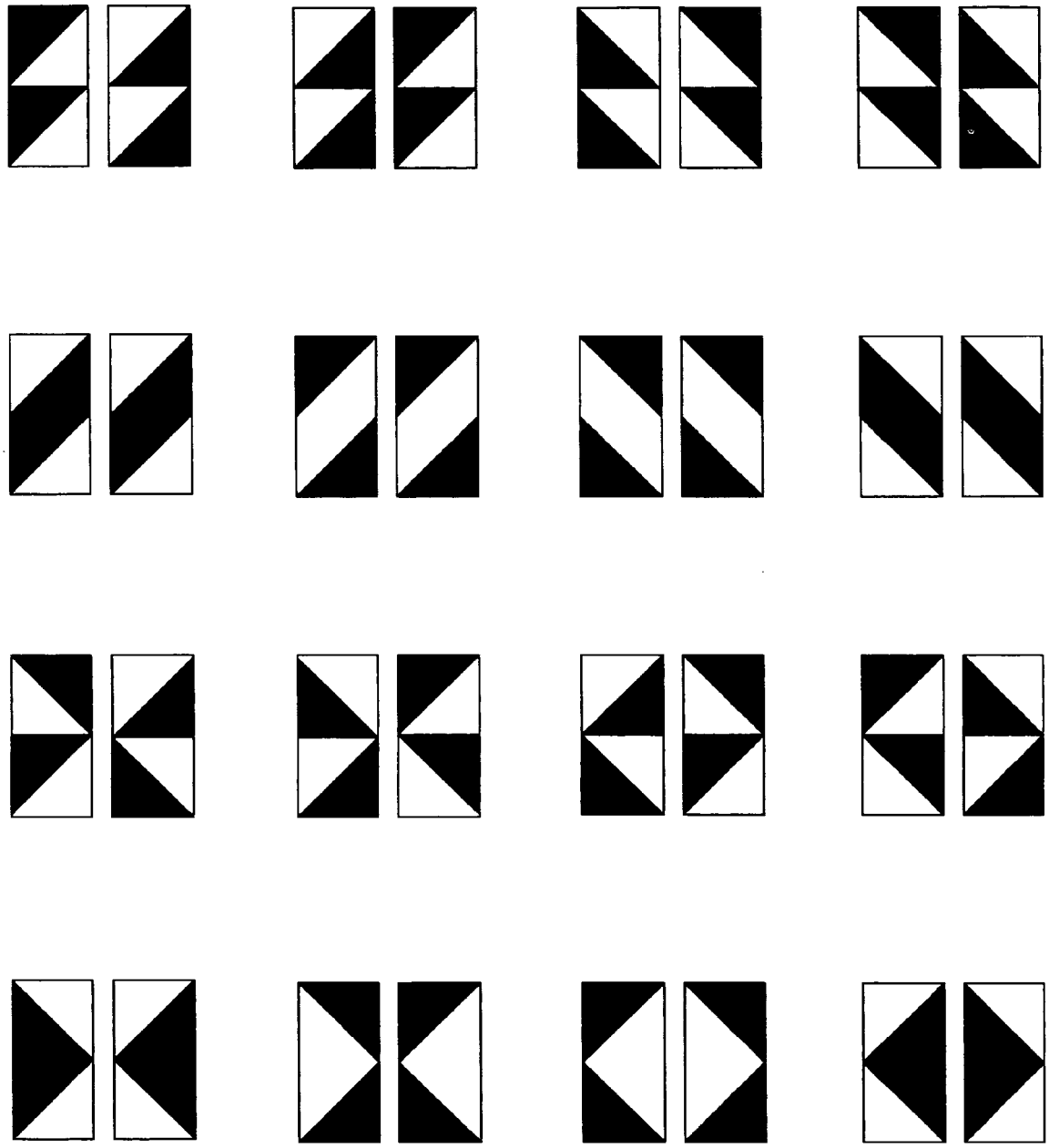

FIG. 8 demonstrates the effect of rotating each card of the Mosaic set.

Figure 9:
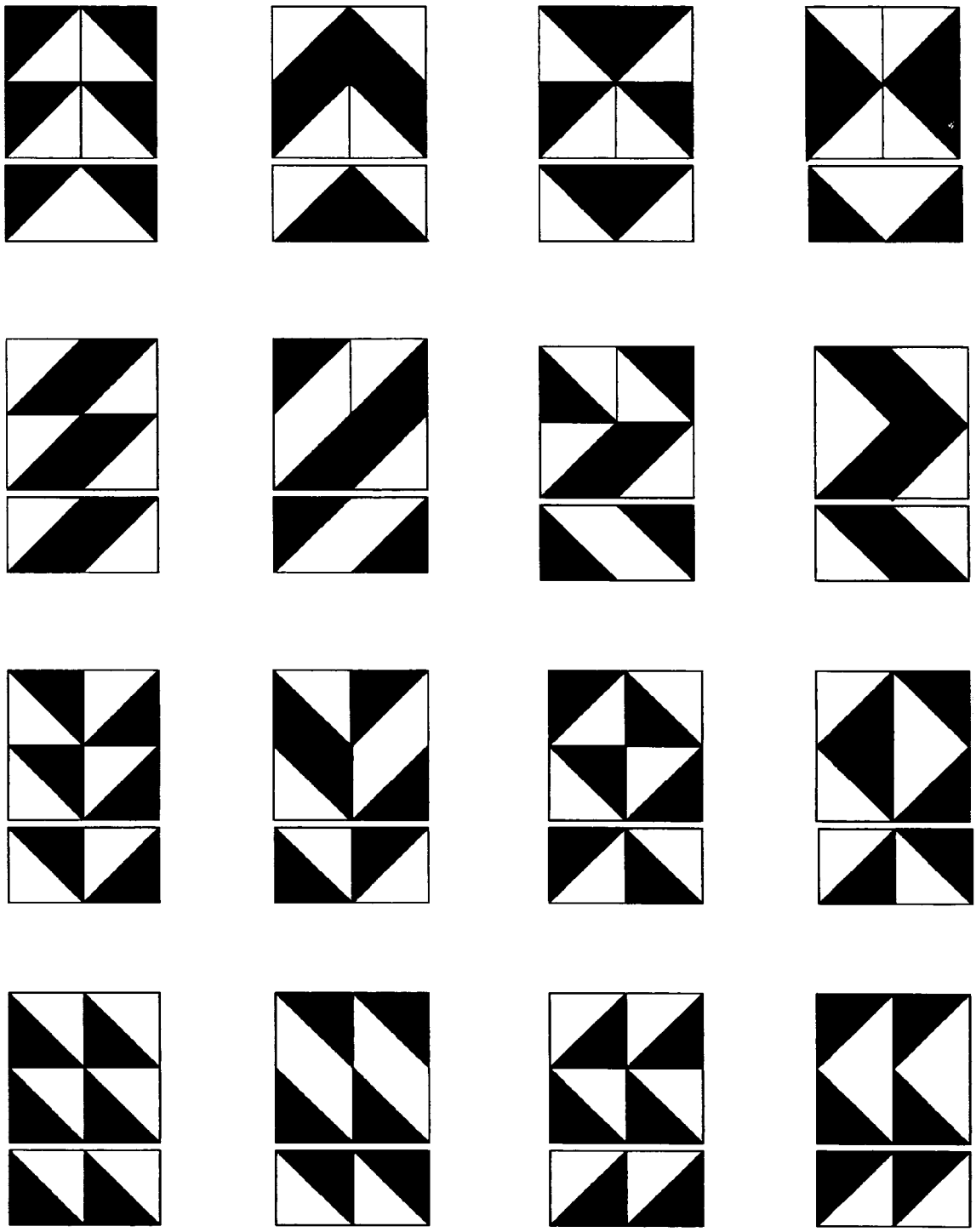

FIG. 9 demonstrates cross family association by perpendicular association.

Figure 10:
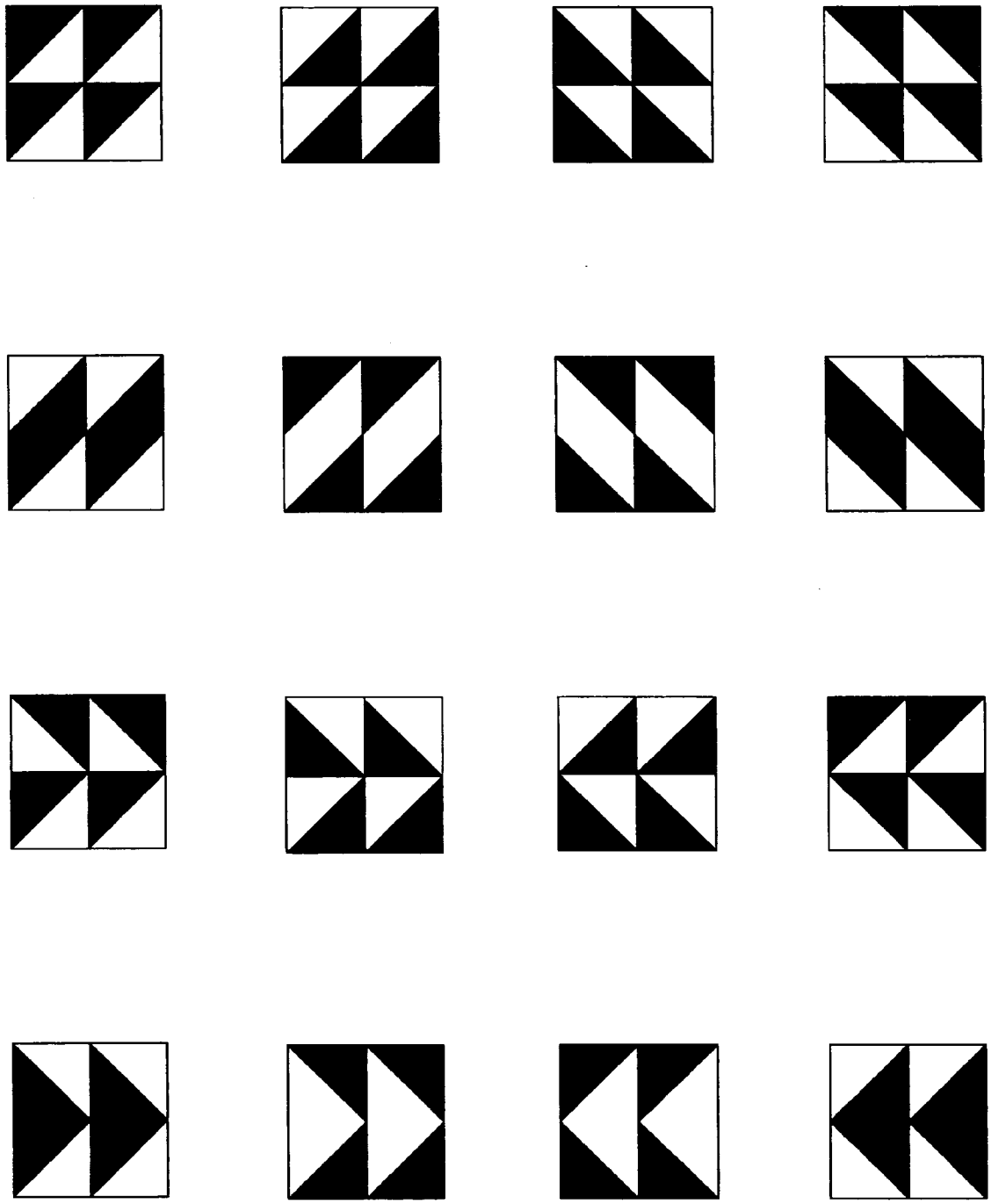

FIG. 10 shows the Mosaic suit arranged in identical pair groups.

Figure 11:
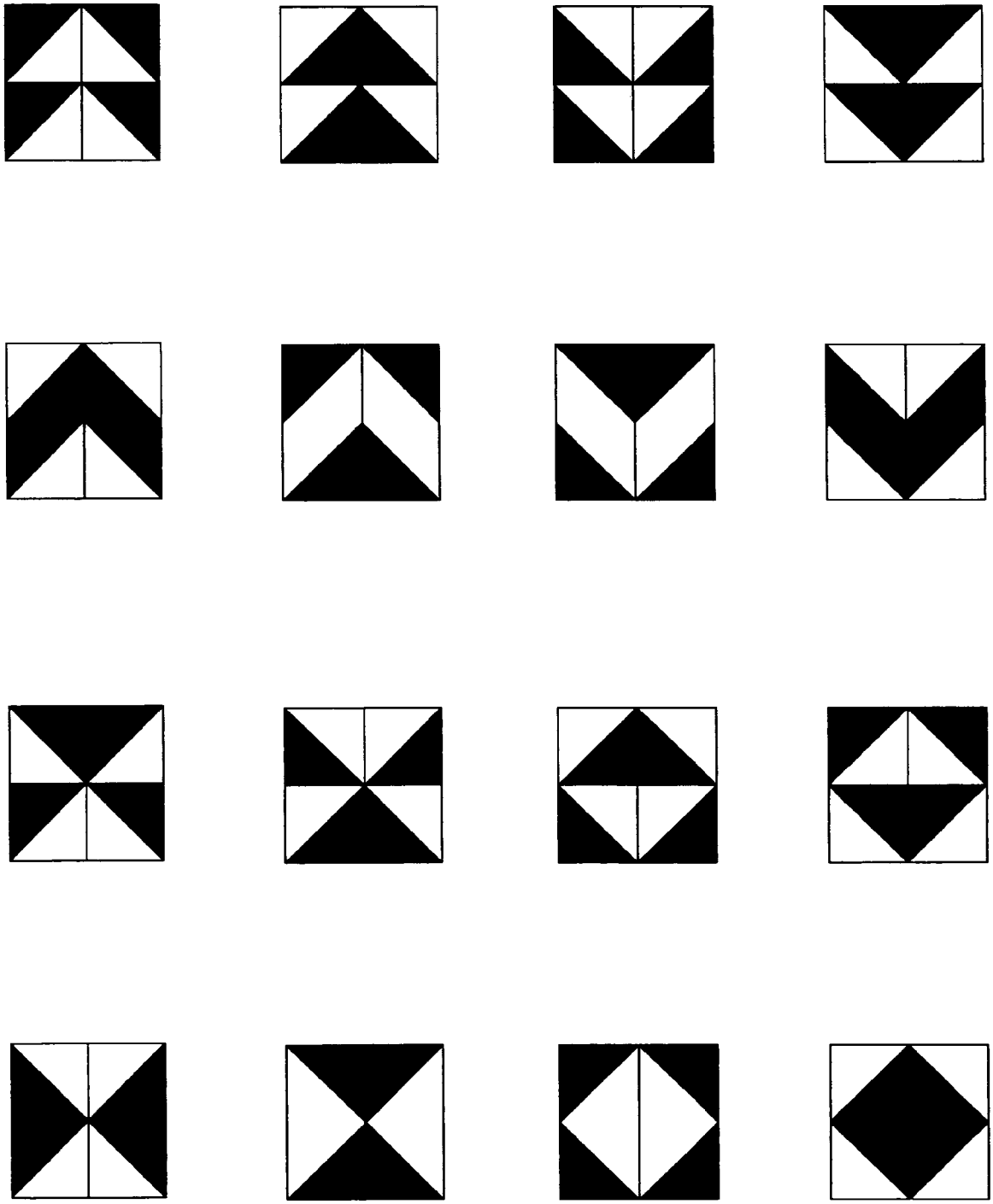

FIG. 11 shows the Mosaic suit arranged in reflective pair groups.

Figure 12:
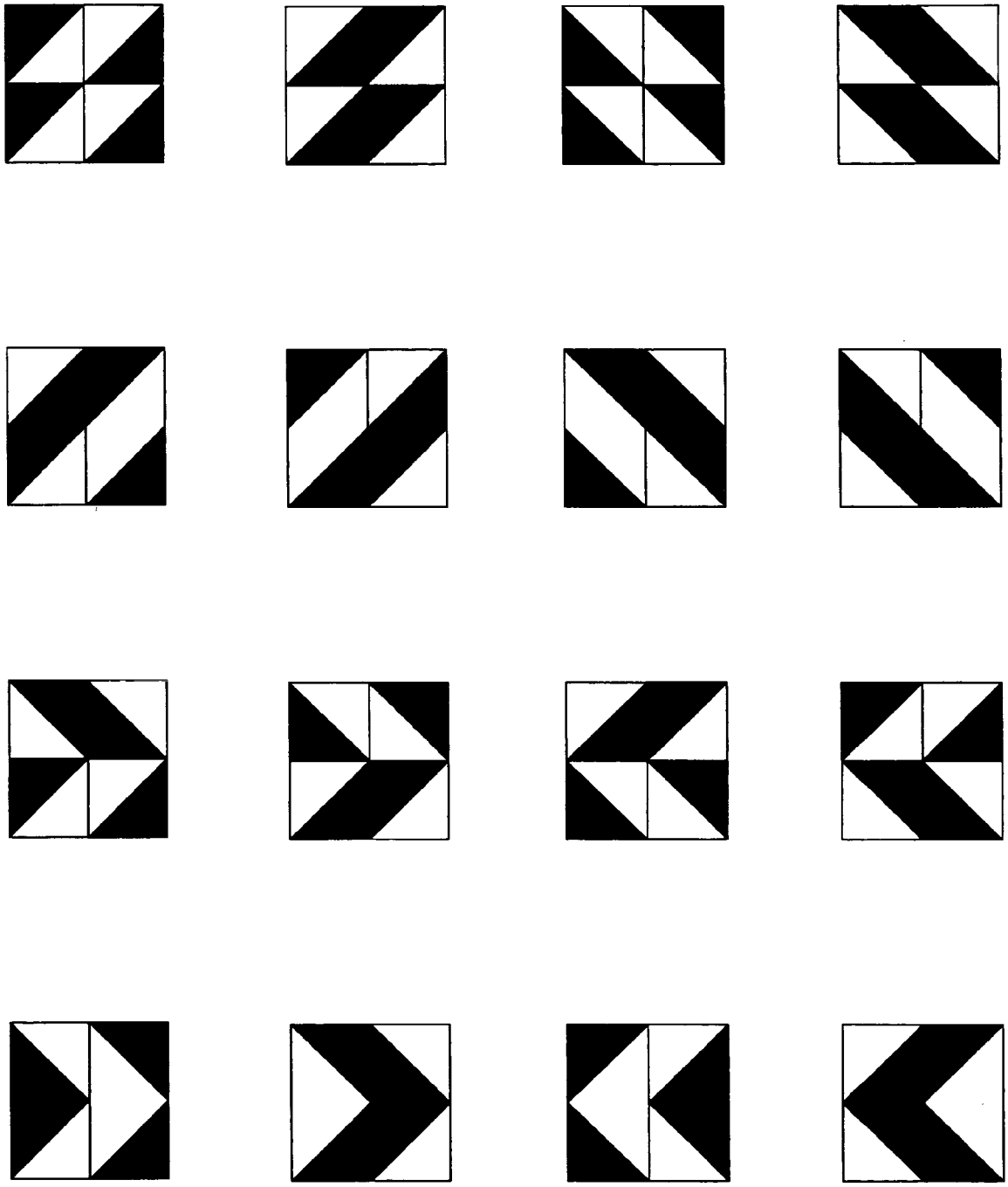

FIG. 12 shows the Mosaic suit arranged in complementary pair groups.

Figure 13:
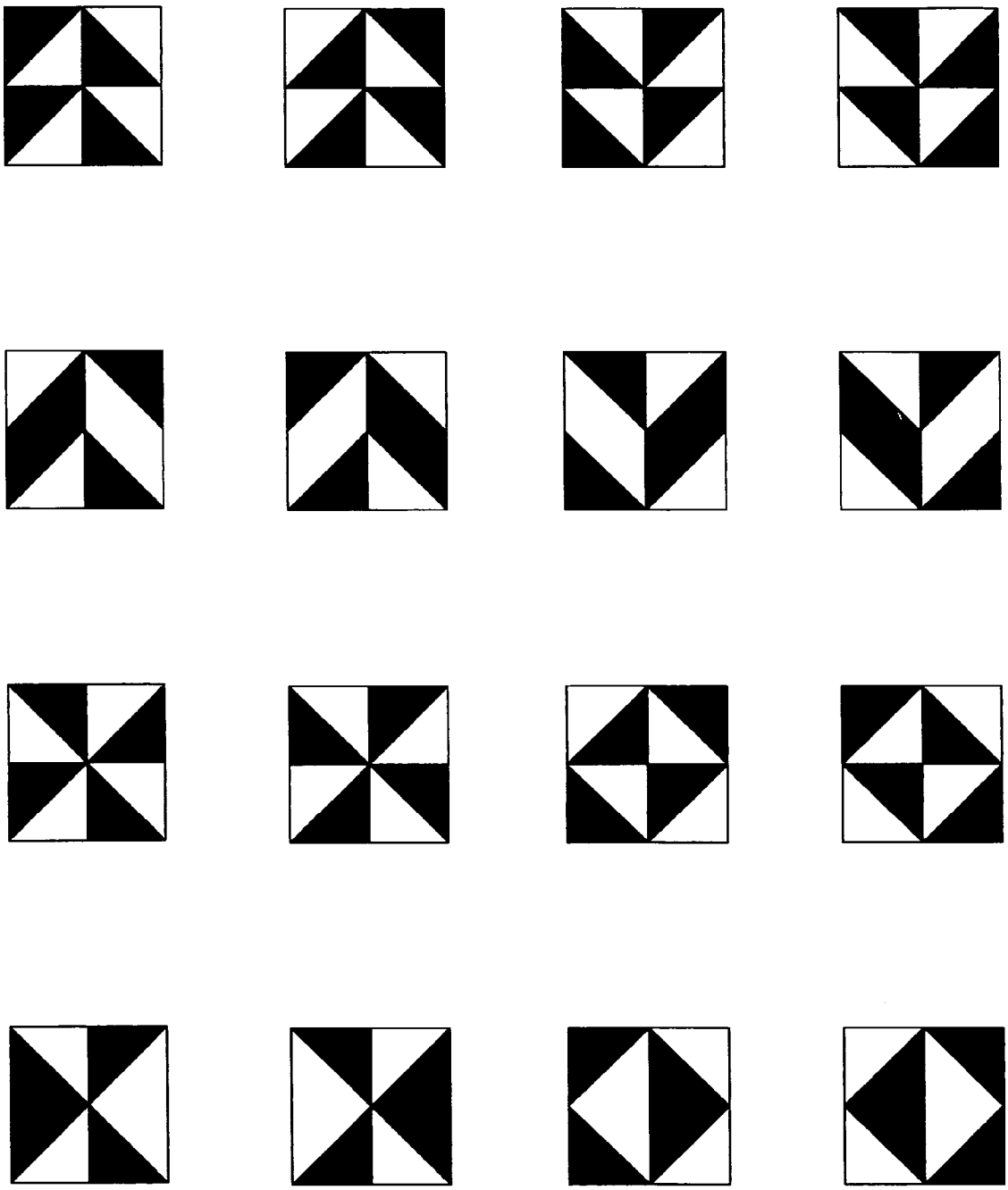

FIG. 13 shows the Mosaic suit arranged in contrary pair groups.

Figure 14:
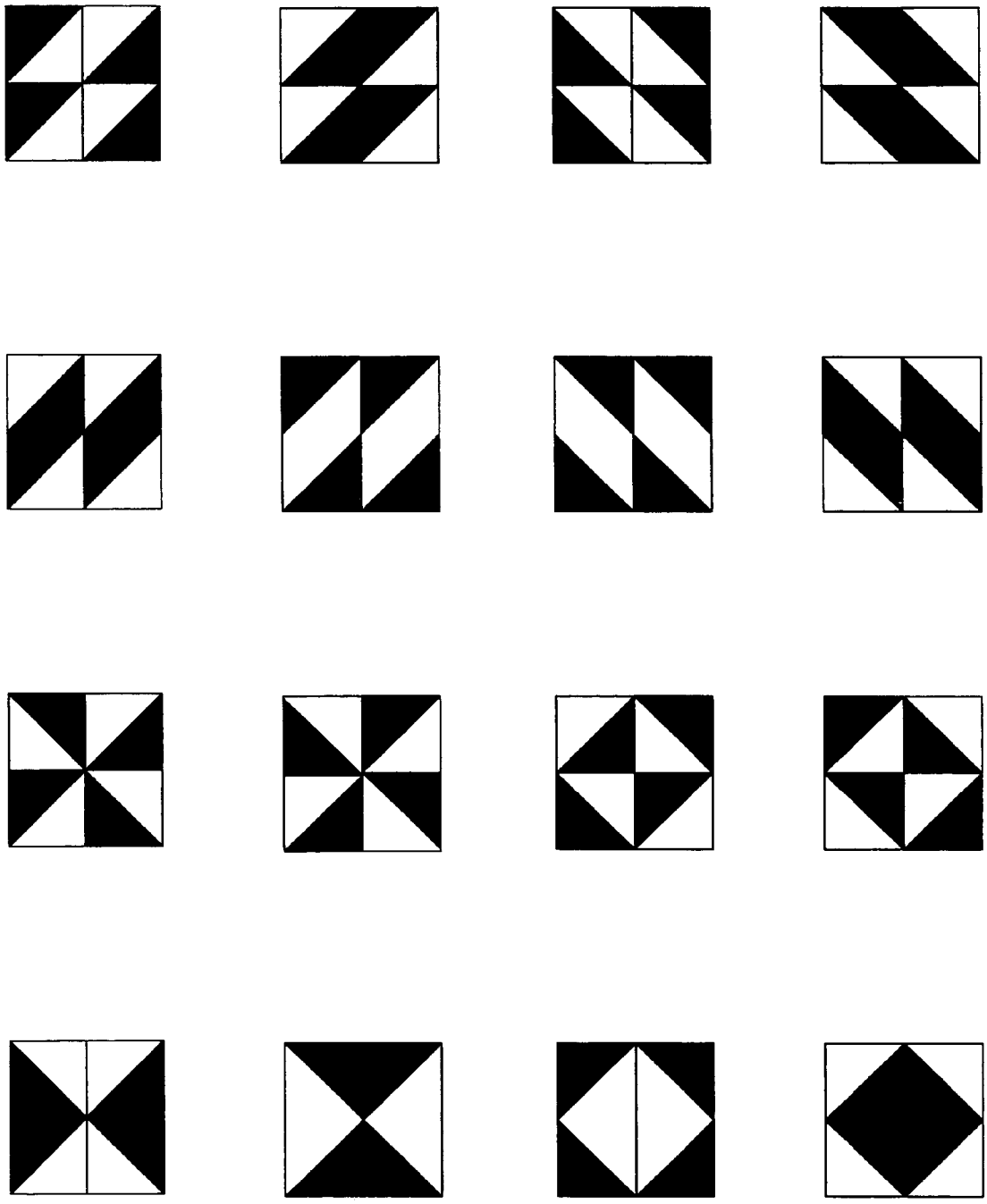

FIG. 14 shows the Mosaic suit arranged in identical pair groups with the second card of the pair rotated 180 degrees.

Figure 15:
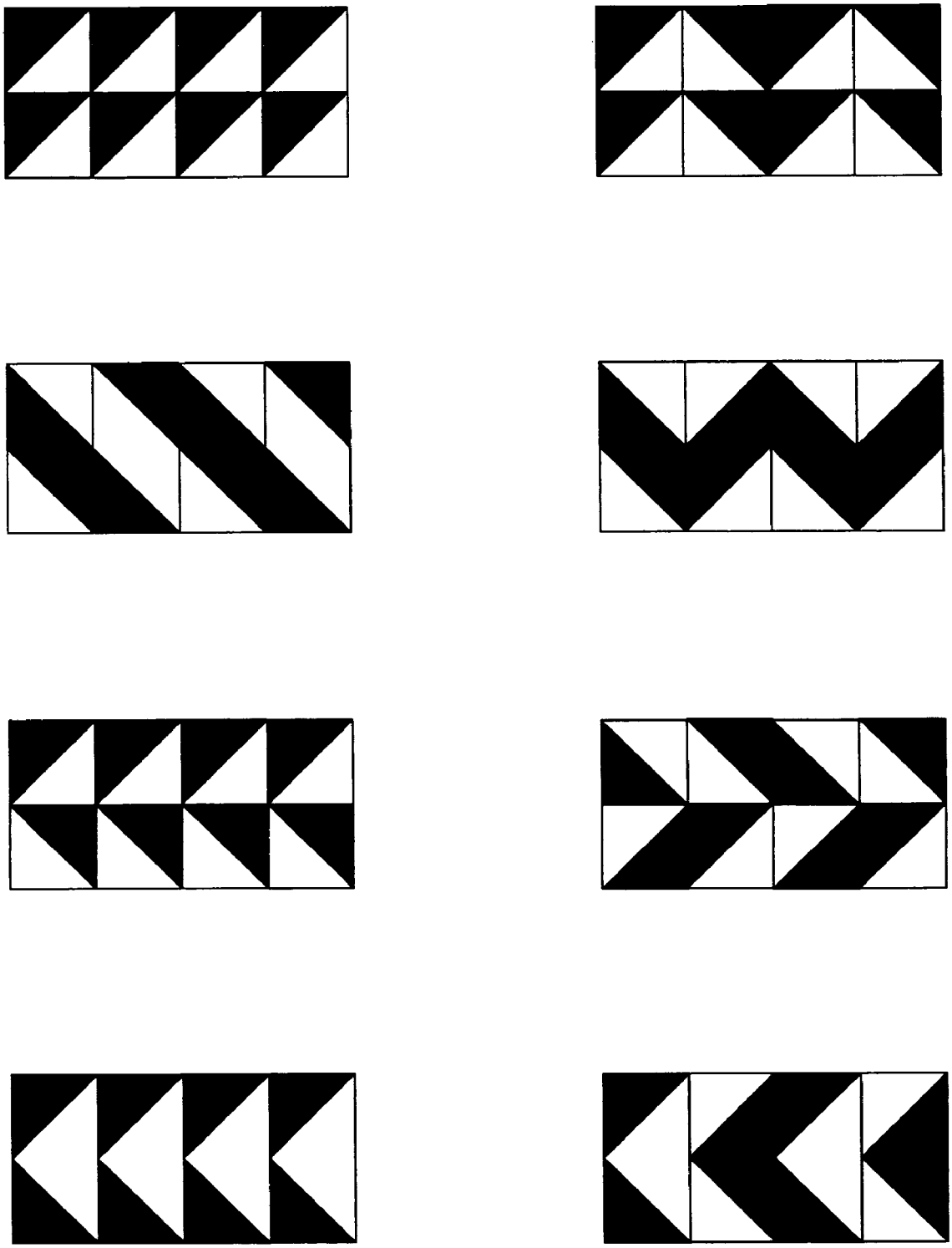

FIG. 15 shows examples of 4 card Mosaic series.

Figure 16:
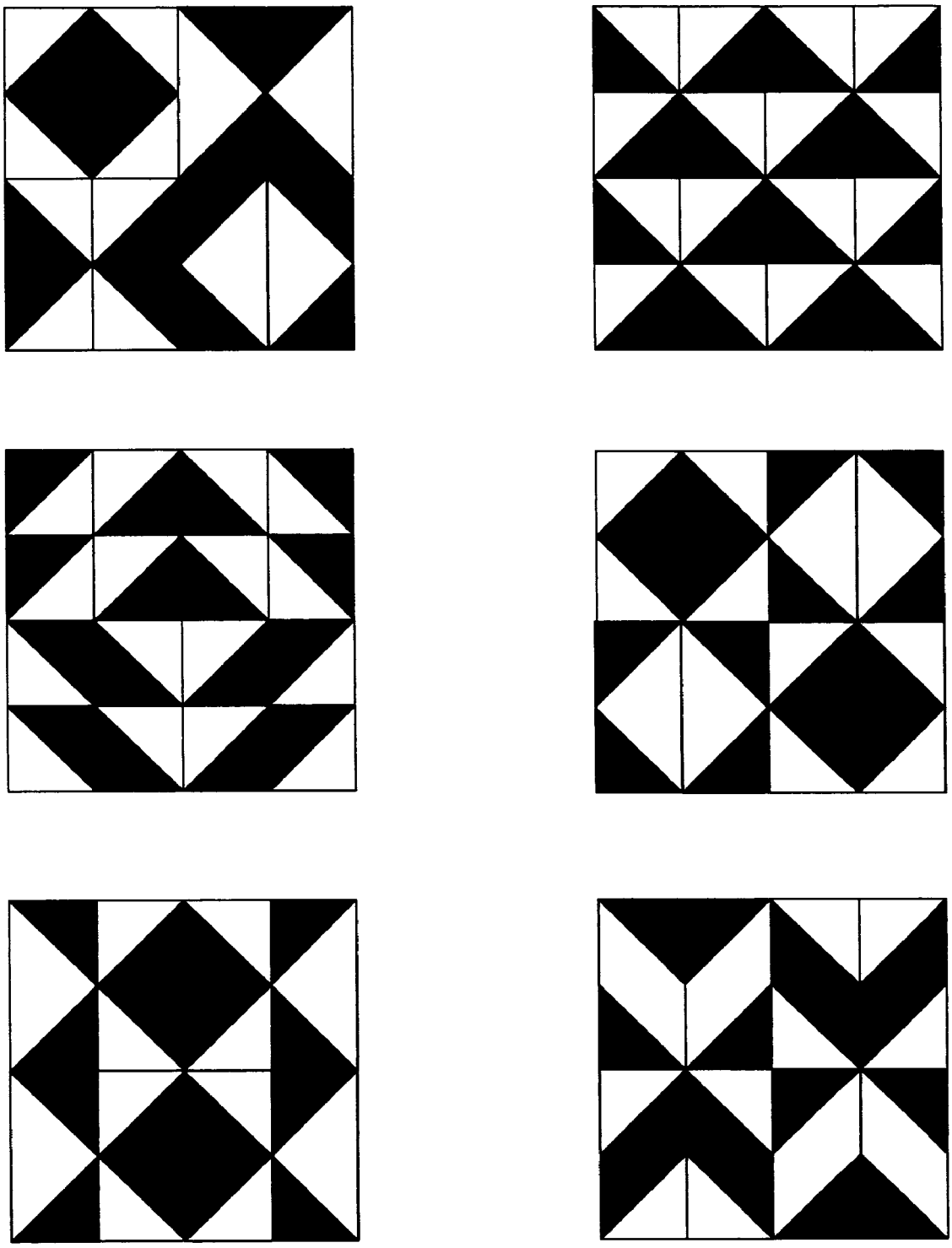
Figure 17:
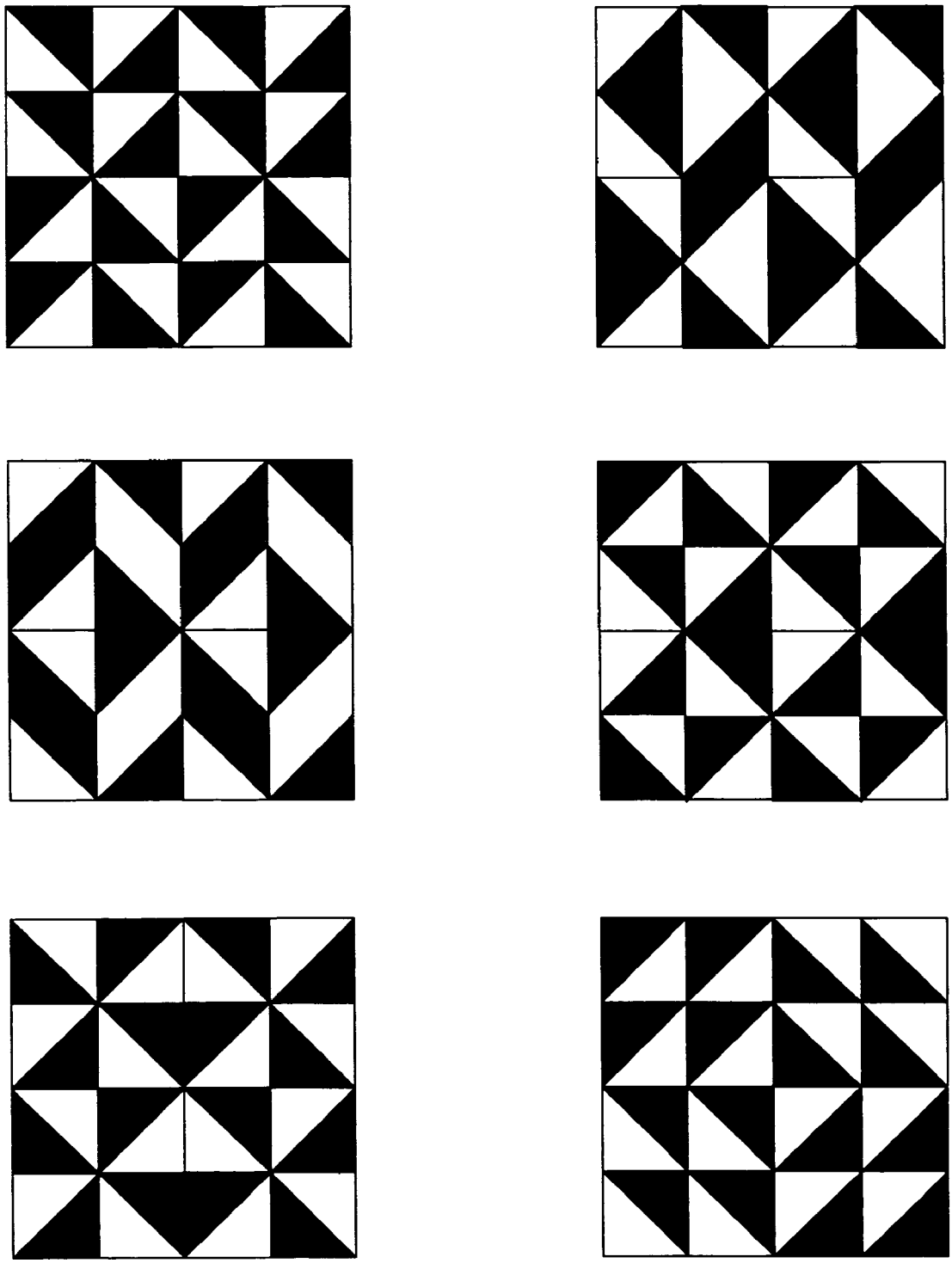

FIGS. 16 & 17 show examples of 8 card Mosaics.

Figure 18:
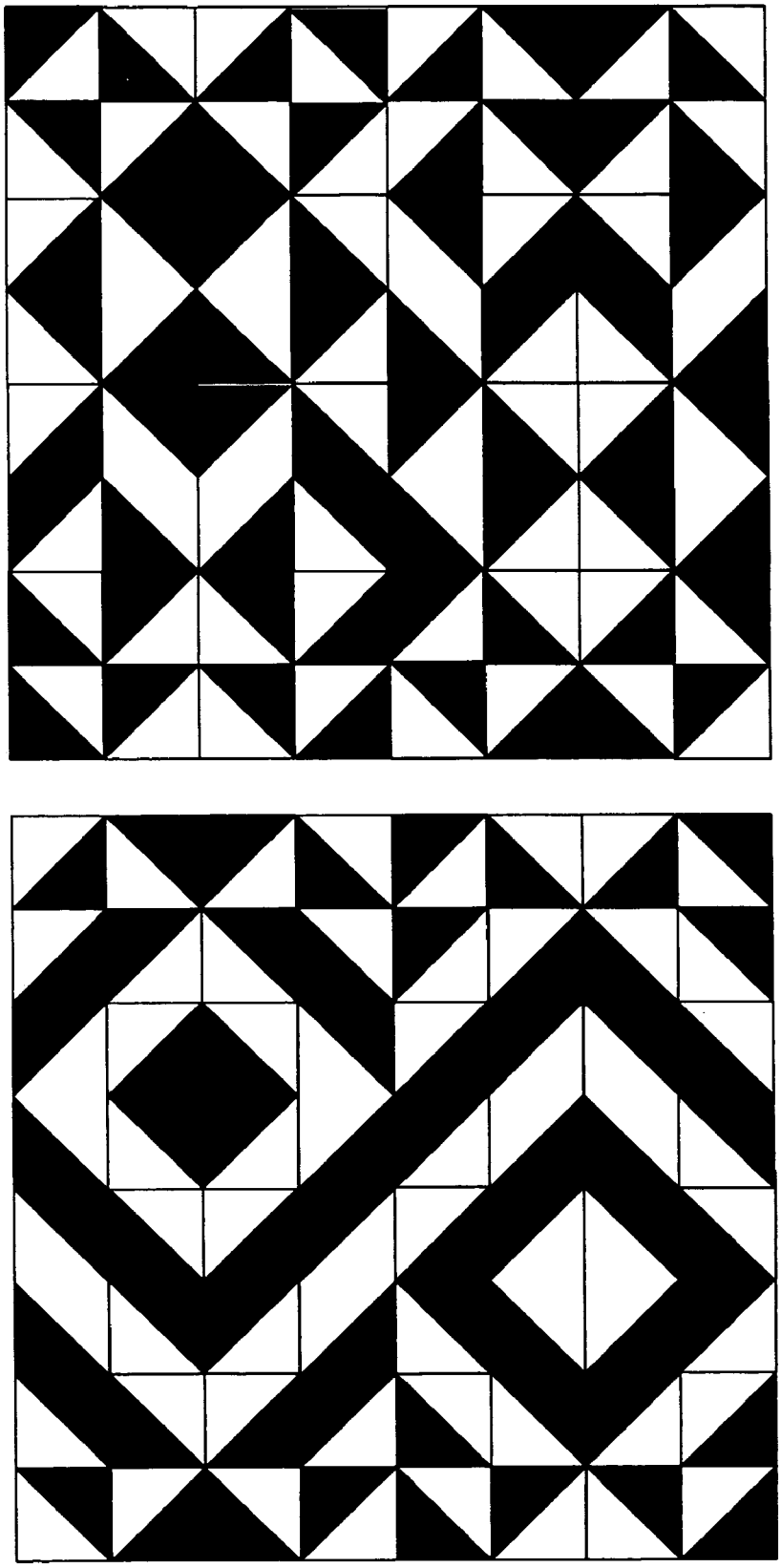

FIG. 18 shows examples of 32 card Mosaic suits.

Figure 19:
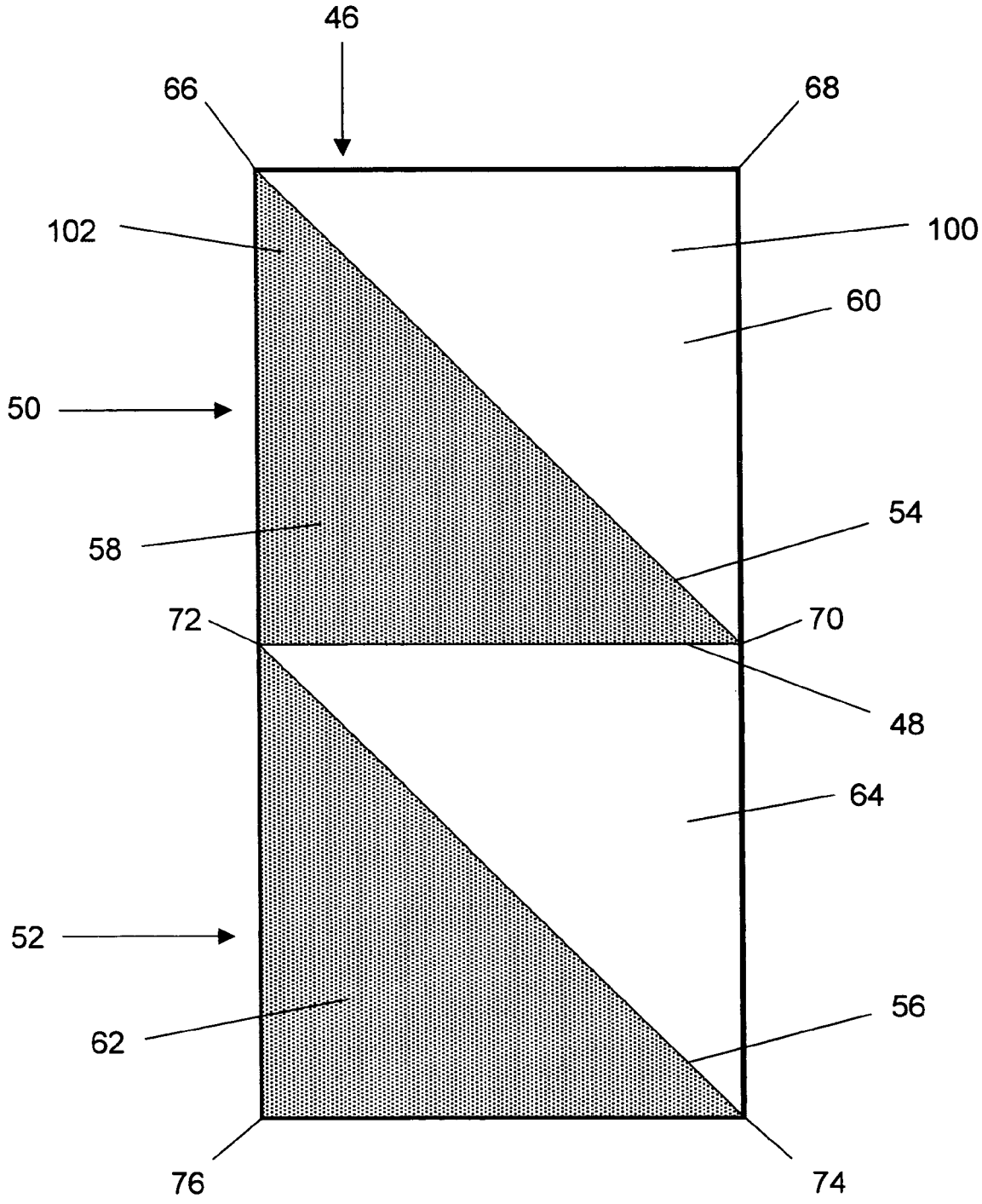

FIG. 19 shows a detailed view of a game piece, from the preferred deck known as the "Z-deck."

Figure 20:
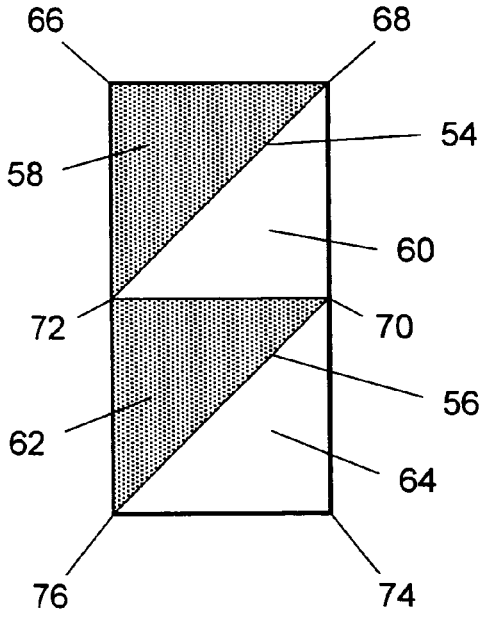

FIG. 20 shows a detailed view of a game piece within the Serra family.

Figure 21:
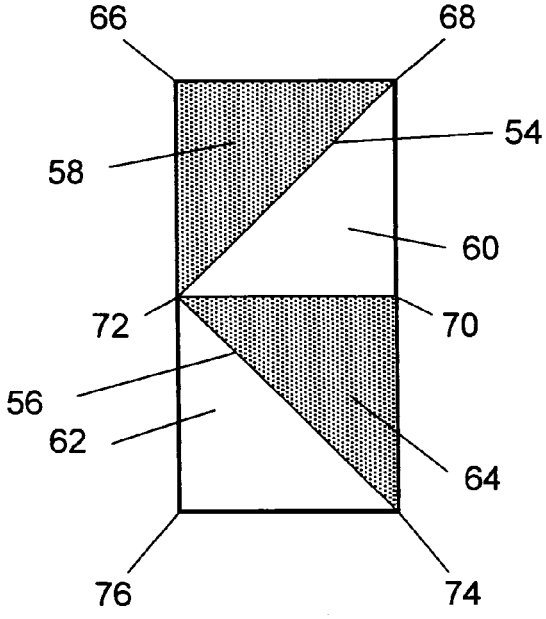

FIG. 21 shows a detailed view of a game piece within the Rota family.

Figure 22:
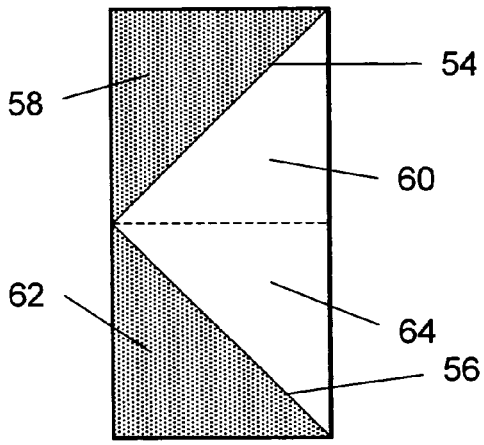

FIG. 22 shows a detailed view of a game piece within the Tessa family.

Figure 23:
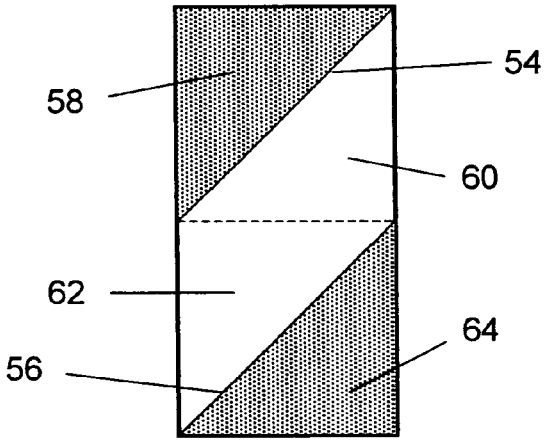

FIG. 23 shows a detailed view of a game piece within the Para family.

Figure 24:
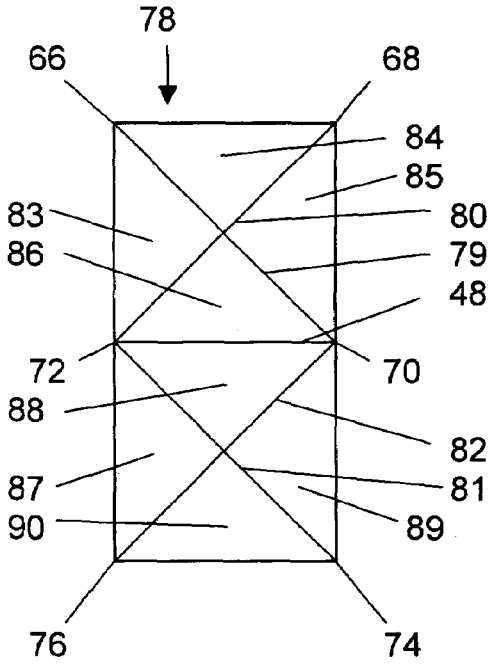

FIG. 24 shows a detailed view of an alternate game piece from the deck known as the "X-deck."

Figure 25:
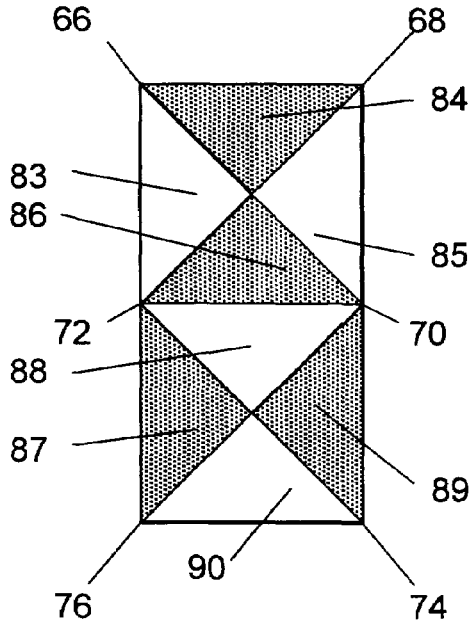

FIG. 25 shows a detailed view of an alternate game piece from the deck known as the "X-deck."

Figure 26:
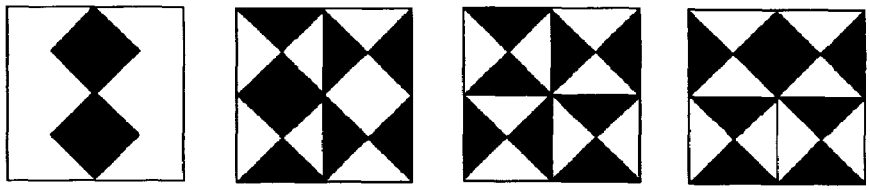

FIG. 26 shows "X-deck" game pieces in relations of reflection, complementarity, contrariety, and identity.

Figure 27:
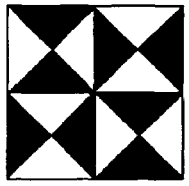

FIG. 27 shows an "X-deck" rotational transformation.

Figure 28:
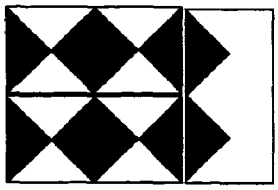

FIG. 28 shows perpendicular association using "X-deck" cards.

Figure 29:
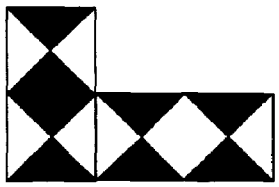

FIG. 29 shows a partial perpendicular association using "X-deck" cards.

Figure 30:
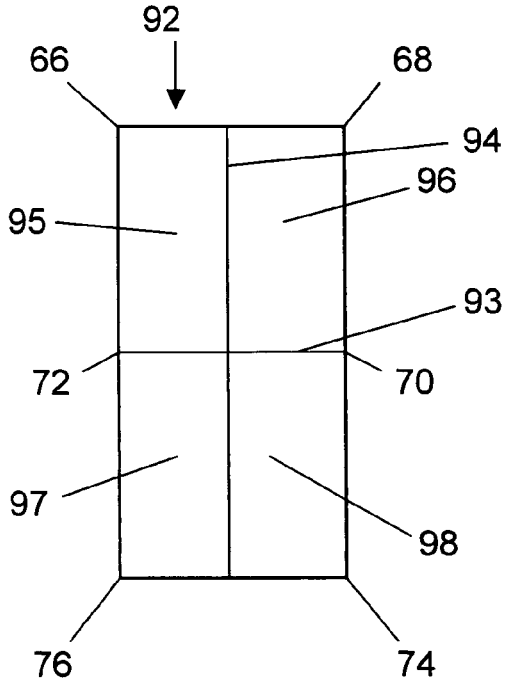

FIG. 30 shows a detailed view of an alternate game piece from the deck known as the "T-deck."

Figure 31:
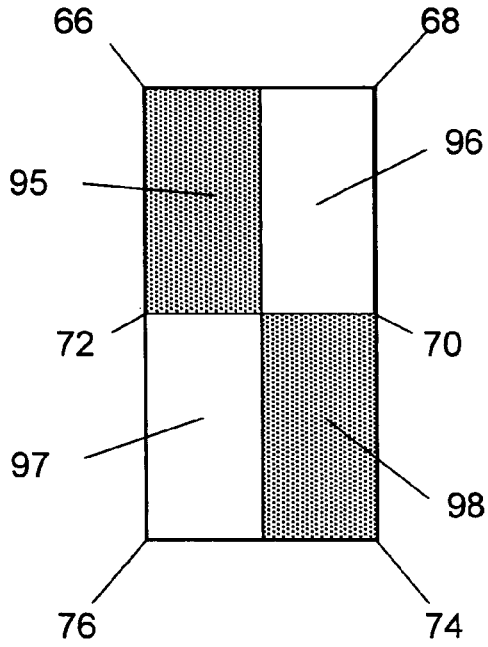

FIG. 31 shows a detailed view of a "T-deck" card.

Figure 32:
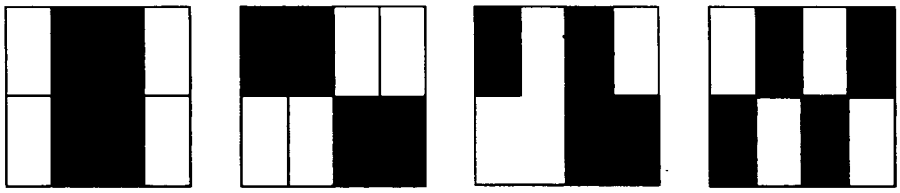

FIG. 32 shows "T-deck" cards in relations of reflection, complementarity, contrariety, and identity.

Figure 33:
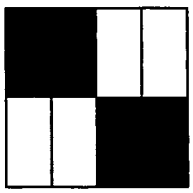

FIG. 33 shows a "T-deck" rotational transformation.

Figure 34:
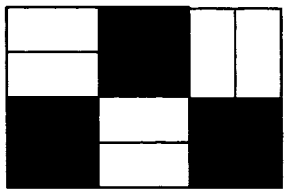

FIG. 34 shows perpendicular association using "T-deck" cards.

Figure 35:
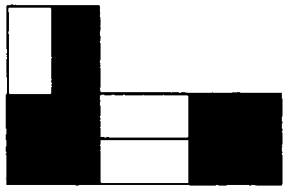

FIG. 35 shows a partial perpendicular association using "T-deck" cards.

Figure 36:
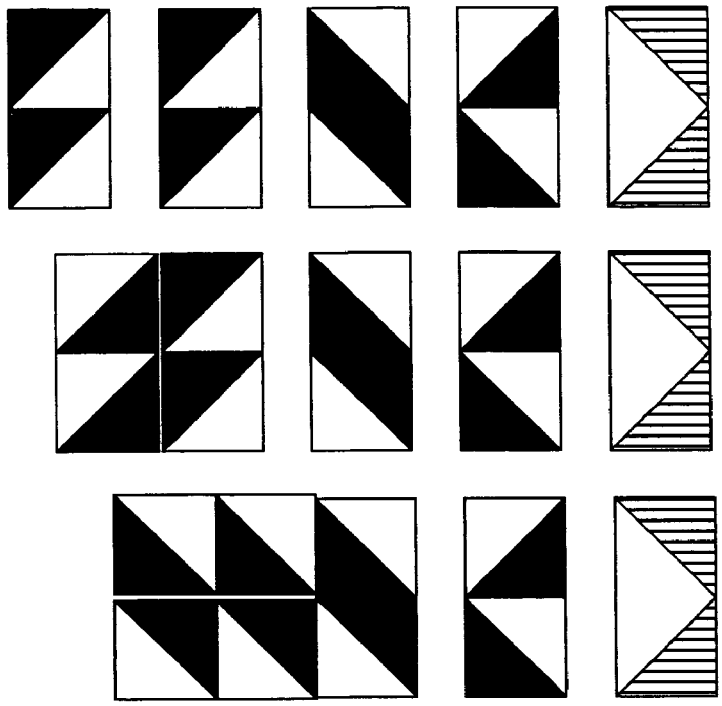

FIG. 36 shows organization of a hypothetical hand of Mosaic Poker into geometric sets.

Figure 37:
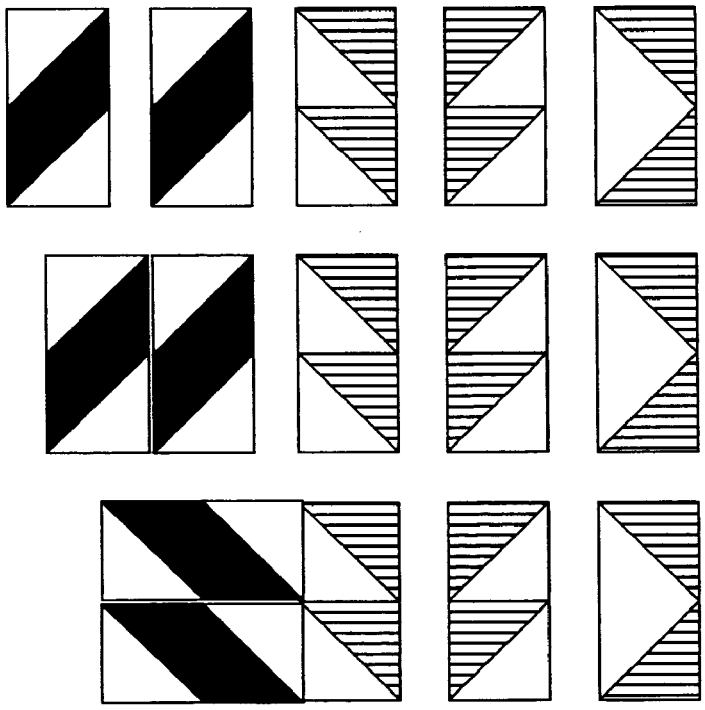

FIG. 37 shows organization of a hand of Mosaic Poker into geometric sets.

Figure 38:
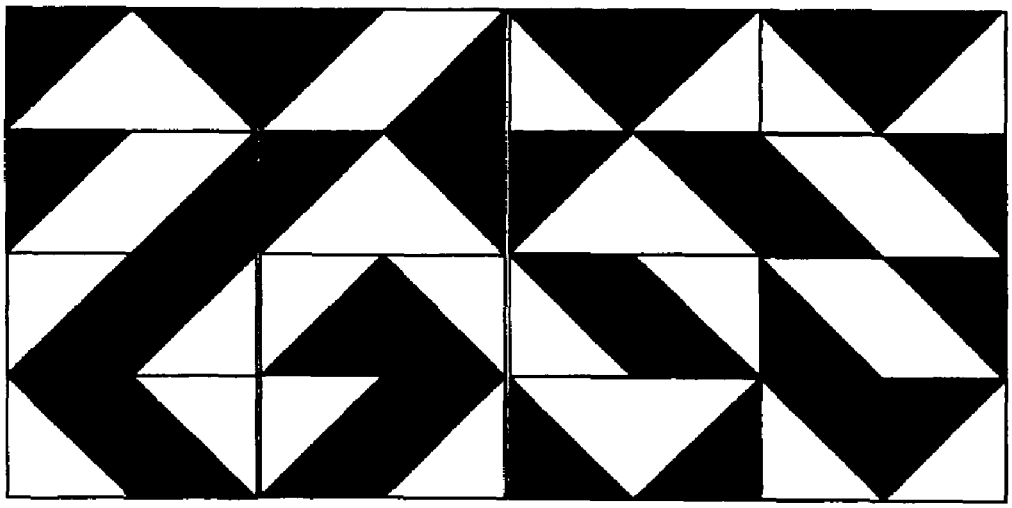

FIG. 38 shows the random array at the start of a hypothetical game of Array.

Figure 39:
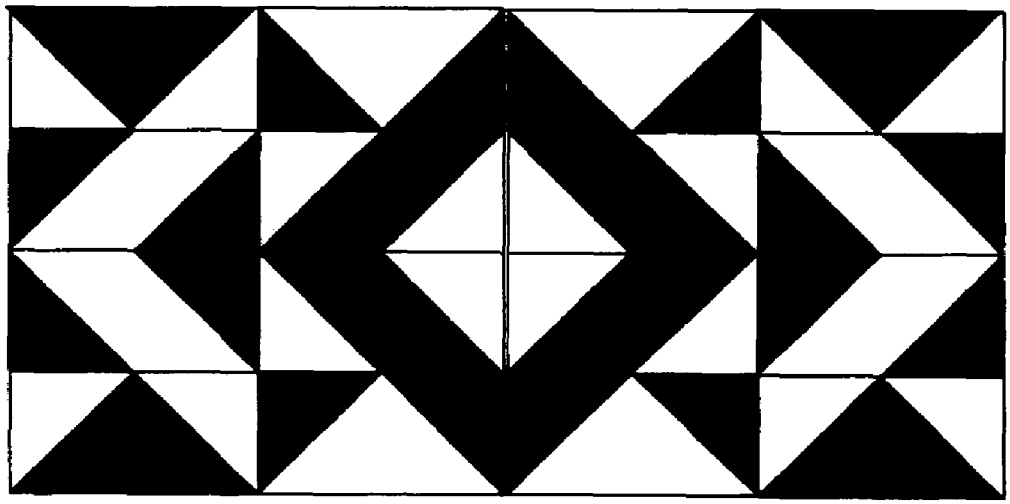

FIG. 39 shows the end game array organized into a symmetrical pattern.

Figure 40:
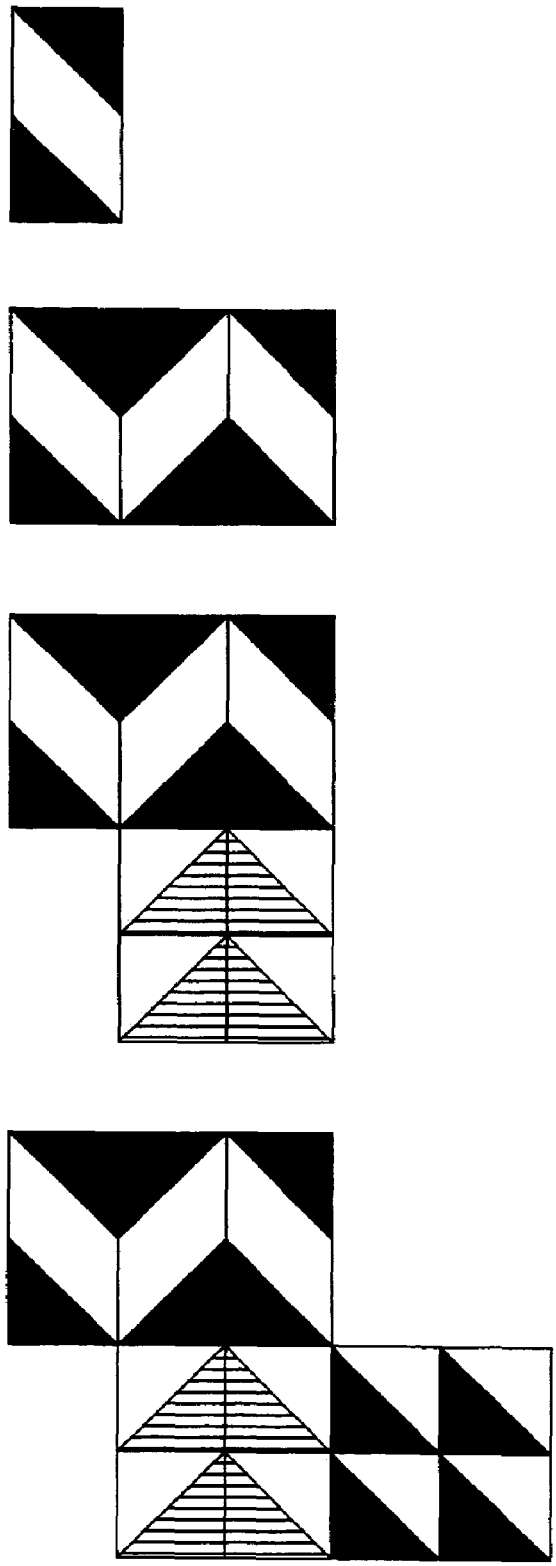

FIG. 40 shows the progression of the game Sequences through three hands of play.

REFERENCE NUMERALS IN THE DRAWINGS

10 basic square element
10TR basic square element, Top-Right (TR) orientation
10BR basic square element, Bottom-Right (BR) orientation
10BL basic square element, Bottom-Left (BL) orientation
10TL basic square element, Top-Left (TL) orientation
11 card Serra Totus
12 card Serra Prime
13 card Serra Nam
14 card Serra Contra
21 card Para Totus
22 card Para Prime
23 card Para Nam
24 card Para Contra
31 card Rota Totus
32 card Rota Prime
33 card Rota Nam
34 card Rota Contra
41 card Tessa Totus
42 card Tessa Prime
43 card Tessa Nam
44 card Tessa Contra
46 game piece preferred "Z" deck
48 bisector
50 first quadrangle
52 second quadrangle
54 first diagonal
56 second diagonal
58 first triangle
60 second triangle
62 third triangle
64 fourth triangle
66 first corner
68 second corner
70 third corner
72 fourth corner
74 fifth corner
76 sixth corner
78 game piece alternate "X"
79 first diagonal
80 second diagonal
81 third diagonal
82 fourth diagonal
83 first triangle
84 second triangle
85 third triangle
86 fourth triangle
87 fifth triangle
88 sixth triangle
89 seventh triangle
90 eighth triangle
92 game piece alternate "T"
93 short bisector
94 long bisector
95 first rectangle
96 second rectangle
97 third rectangle

98 fourth rectangle
100 base color region
102 first suit color region

DETAILED DESCRIPTION

The concept of playing cards having a display surface divided into rectilinear geometric regions can be realized in many different embodiments. Several—though by no means all—of these embodiments are disclosed in the following. For purposes of organizational clarity, each embodiment discussed is given a name. The first embodiment is a set of playing cards known as a "Z-deck."

FIG. 19 shows a game piece from the "Z-deck" in detail (game piece preferred "Z-deck"(46)). The game piece (a thin playing card, in this case) has two sides and an opaque construction. The side facing away from the viewer is the "back" of the card. The back of all the cards are alike. The side facing toward the viewer is known as the "display surface," and these are not all alike. The display surface is divided into rectilinear geometric regions of different colors.

A thin playing card is the preferred embodiment for the game piece. However, the reader should bear in mind that rigid tiles, electronic media, or other embodiments can be substituted for a conventional playing card throughout this disclosure.

For the "Z-deck," the rectilinear geometric regions are created in the following fashion: The display surface is divided into first quadrangle (50) and second quadrangle (52) by bisector (48). First quadrangle (50) is divided into first triangle (58) and second triangle (60) by first diagonal (54). Second quadrangle (52) is divided into third triangle (62) and fourth triangle (64) by second diagonal (56). First triangle (58) is given a color. Second triangle (60) must be given a color which is different from the color within first triangle (58). Third triangle (62) is given a color. Fourth triangle (64) is then given a color which is different from the color within third triangle (62).

For the specific version shown, the two quadrangles are squares. This need not be the case, however. If the card's dimensions are varied appropriately, the two quadrangles can be rectangles.

Three or more colors can be used. However, for a simplified example using only two colors, it is helpful to refer to the background color of the game piece as the "base color." A contrasting color can then be employed to create the geometric patterns. This contrasting color is referred to as a "suit color." In the view shown in FIG. 19, the base color is denoted as base color region (100). The suit color is denoted as first suit color region (102).

The reader should note that the two diagonals can slope upward rather than downward. In FIG. 19, first diagonal (54) lies between first corner (66) and third corner (70), while second diagonal (56) lies between fourth corner (72) and fifth corner (74). In the card shown in FIG. 20, first diagonal (54) lies between fourth corner (72) and second corner (68). Second diagonal (56) lies between sixth corner (76) and third corner (70). FIG. 23 shows a card having the same orientation for the diagonals, but different coloring of the triangles.

The reader should also note that the diagonals need not be parallel (see the cards shown in FIGS. 21 and 22). The playing cards shown in FIGS. 19 through 23 all fit the definition of the rectilinear geometric regions given above (for the "Z-deck").

Figure 1:
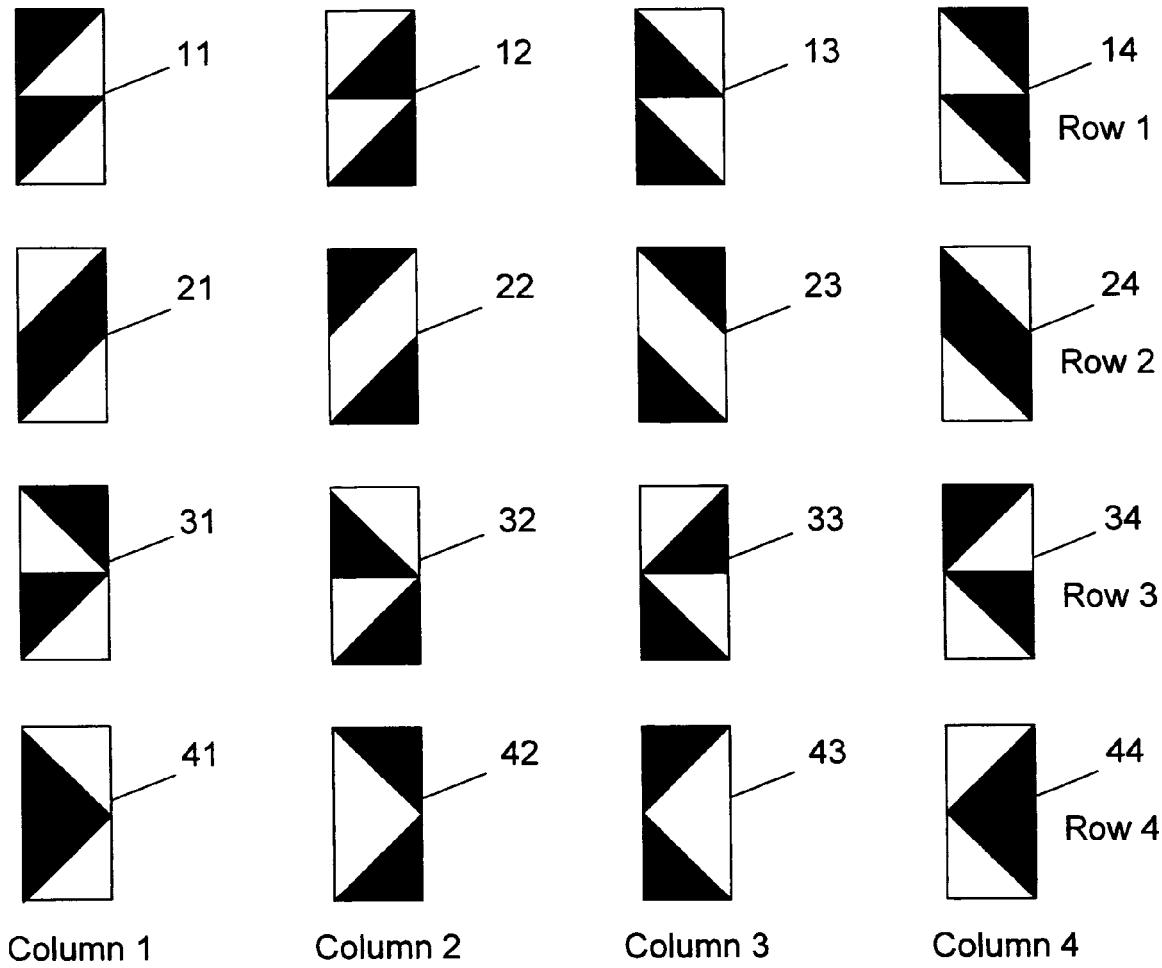
FIG. 1 shows a Mosaic set comprised of 16 unique cards from the preferred deck known as the "Z-deck," which compose one half of a Mosaic suit and one quarter of the Mosaic deck.

Of course, more permutations are possible under this definition. FIG. 1 shows a set of game pieces displaying all the permutations possible under the "Z-deck" definition (using only a base color and a single suit color). For the example shown, the base color is white and the suit color is black.

This fundamental set of sixteen unique "Z-deck" cards is referred to as the "Mosaic set." For many games, it is desirable to employ more than sixteen cards. The Mosaic set can therefore be used to create larger sets. The following is an example: A Mosaic suit of thirty-two cards consists of a pair of Mosaic sets. A Mosaic deck of sixty-four cards consists of two Mosaic suits. Since suit differentiation is often desirable for enriched game play, the two Mosaic suits are preferably differentiated by color. Thus, the first Mosaic suit could consist of thirty-two cards (two identical sixteen card Mosaic sets) having a white base color and a black suit color. The second Mosaic suit could then consist of thirty-two cards (two identical sixteen card Mosaic sets) having a white base color and a red suit color.

Figure 2:
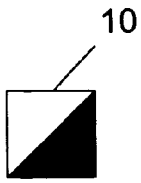
FIG. 2 shows the basic square element comprising the Mosaic playing-cards.

A system of detailed nomenclature is helpful to the thorough understanding of the "Z-deck" cards and how they can interrelate according to various game rules. The reader will recall that the display surface of each "Z-deck" card is divided by bisector (48) into two quadrangles. FIG. 2 shows one of these quadrangles by itself. Basic square element (10) is divided by a diagonal into two triangles. According to the "Z-deck" definition, these two triangles must have contrasting colors.

Figure 3:
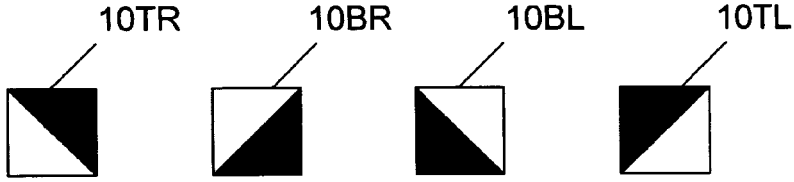
FIG. 3 shows the permutated four normal orientations of the basic square element.

FIG. 3 shows the four possible permutations achieved by varying the diagonal slope and the coloring of the triangles (Again, this example assumes a base color and only a single suit color). These permutations are described in order to simplify the precise descriptions of the individual playing-cards to follow.

(10TR)—Orientation 'TR' has the suit field of the quadrangle at the top-right.

(10BR)—Orientation 'BR' has the suit field of the quadrangle at the bottom-right.

(10BL)—Orientation 'BL' has the suit field of the quadrangle at the bottom-left.

(10TL)—Orientation 'TL' has the suit field of the quadrangle at the top-left.

The individual cards of the Mosaic set can most precisely be described by the unique orientation of the suit field within each of the two adjoining quadrangles comprising each card. Referring to FIG. 1 and FIG. 3, the following chart describes each card by reference number followed in parentheses by orientation of the suit field within the top quadrangle, and orientation of the suit field within the bottom quadrangle.

| | | | |
|---|---|---|---|
| Card 11 (TL, TL) | Card 21 (BR, TL) | Card 31 (TR, TL) | Card 41 (BL, TL) |
| Card 12 (BR, BR) | Card 22 (TL, BR) | Card 32 (BL, BR) | Card 42 (TR, BR) |
| Card 13 (BL, BL) | Card 23 (TR, BL) | Card 33 (BR, BL) | Card 43 (TL, BL) |
| Card 14 (TR, TR) | Card 24 (BL, TR) | Card 34 (TL, TR) | Card 44 (BR, TR) |

As a matter of interest, the cards of the "Z-deck" Mosaic set can be described as the set of permutations of all possible orientations of two adjoining quadrangles that are subdivided into four triangles by the two diagonals. The permutations can be seen in the chart above, as well as by inspection of FIG. 1.

Observing the four cards in each of the columns of FIG. 1 it can be seen that the orientation of the bottom quadrangle is consistent throughout the column while the top quadrangle is permutated through the four possible orientations. Notice that each of the four columns presents one of the four possible orientations for the bottom quadrangle.

While the Mosaic deck can be played without naming the cards, a well-developed nomenclature is essential to academic study and continued development of this gaming system. Inspection of FIG. 1 will reveal rather obvious similarity between the cards that are grouped in rows. The rows of cards in FIG. 1 are families of related cards. For academic purposes and convenience in subsequent writing, these family groups are named based upon the characteristics of their appearance:

Row 1 of FIG. 1 (consisting of cards 11, 12, 13 & 14) demonstrates a serrated appearance. Derived from the Latin serra for "saw", this family group is named: Serra (ser'ra).

Row 2 of FIG. 1 (consisting of cards 21, 22, 23 & 24) presents a strong parallelism. Derived from the Greek prefix para- for "alongside", this family group is named: Para (par'a).

Row 3 of FIG. 1 (consisting of cards 31, 32, 33 & 34) possesses a rotational symmetry. Derived from the Latin rota for "wheel", this family group is named: Rota (rō'ta).

Row 4 of FIG. 1 (consisting of cards 41, 42, 43 & 44) presents the half square or right triangle that is elemental to the Mosaic deck. Derived from the Latin tessella for "small square tile", this family group is named: Tessa (tes'sa).

The cards in each row have important relations that will become more evident in subsequent sections. Individual card names will be presented in another section wherein these individual card properties are explored.

The physical operation of the "Z-deck" playing-cards is similar to that of traditional playing-cards. Because the cards are preferably thin, opaque, and rectangular, they may be shuffled, dealt, and played like a traditional deck of playing-cards.

Figure 4:
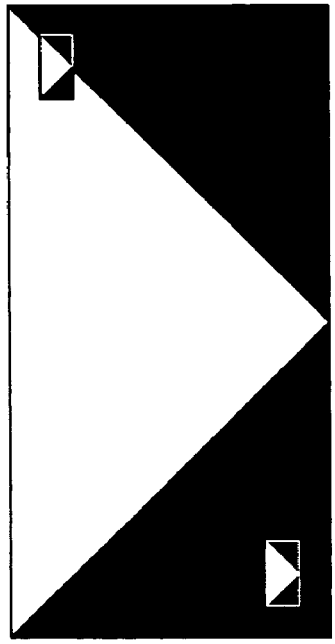
FIG. 4 shows a card at a larger scale with the addition of corner indicia.

Mosaic playing-cards may be handheld like traditional playing-cards. FIG. 4 shows how the addition of indexing indicia improves the ability to survey the cards while handheld. Each card can feature an indexing indicia (a small depiction of the entire display surface) in two of the corners. This feature allows a user to fan a hand of such cards in the traditional manner, thereby allowing the user to visualize the complete appearance of every display surface in the hand without having to lay the cards out where another player can see them.

While the similarity in construction to traditional playing-cards is essential to conventional playing-card play, it is the relations between the cards and the unique properties of the cards that are fundamental to the Mosaic playing-card games. This new deck of playing-cards is rich with new and unique relations and properties not found in other playing-cards and upon which many new and unique games may be based.

The object of many playing-card games is based upon the various relations available between the cards in the deck. Mosaic playing-cards employ relations including complementarity, contrariety, reflection, and identity, in a unique system for game play.

The relations between cards in the "Z-deck" family groups are unique and important elements for play of Mosaic games. Each family group, or row of FIG. 1, consists of four cards that are interrelated as reflections, complementaries, or contraries of one another.

The concept of reflection is well known. Referring to FIG. 1, the reflective relations within the Mosaic card families can be observed by comparing column 2 with column 3, and also by comparing column 1 with column 4. The reflective cards demonstrate an opposition of form, but the retention of color relations.

Complementarity has its origin in the concepts of completion, fulfillment, and the perfect unity of parts. Referring to FIG. 1, the complementary relations within the Mosaic card families can be observed by comparing column 2 with column 1, and also by comparing column 3 with column 4. The complementary cards demonstrate the retention of form but the opposition of color.

Contrariety has its origin in the concepts of opposition and inconsistency. Referring to FIG. 1, the contrary relations within the Mosaic card families can be observed by comparing column 2 with column 4, and also by comparing column 1 with column 3. The contrary cards demonstrate the opposition of both form and color.

The concept of identity is well known. Identical relations within the Mosaic card families are found between identical pairs from the two Mosaic sets that compose a Mosaic suit. The "Z-deck" playing-cards employ these relations of complementarity, contrariety, reflection, and identity, in a unique system for game play.

Providing names for each individual cards within the sixteen card Mosaic set is helpful to academic study and continued development of this gaming system. The names of the individual cards are derived from the various relations within the family group.

Each family group consists of four cards that are interrelated as reflections, complementaries, or contraries of one another. These relations are circular; meaning each card is compared to each other card in the group by one those relations. It is helpful to define one of the columns of FIG. 1 as a starting point. The cards in column 2 are therefore selected to be the "identity" cards, or starting point, for defining the relativity of the various cards in the family. Observe that each identity card in column 2 has its bottom quadrangle in the BR orientation. Put another way, the suit field of the bottom quadrangle is inclined to the right.

Column 2 includes the cards defined as the identity card for each family. The individual identity cards are named by adding the second name 'Prime' to the Mosaic family names. The name Prime is from the Latin prim for "first".

Card 12 is named Serra Prime.

Card 22 is named Para Prime.

Card 32 is named Rota Prime.

Card 42 is named Tessa Prime.

Column 3 includes cards that are reflections of the family identity cards. The individual reflective cards are named by adding the second name 'Nam' to the Mosaic family names. The name Nam is from the Latin nam for "on the other hand".

Card 13 is named Serra Nam.

Card 23 is named Para Nam.

Card 33 is named Rota Nam.

Card 43 is named Tessa Nam.

Column 1 includes cards that are complementaries of the family identity cards. The individual complementary cards are named by adding the second name 'Totus' to the Mosaic family names. The name Totus is from the Latin totus for "complete and whole".

Card 11 is named Serra Totus.

Card 21 is named Para Totus.

Card 31 is named Rota Totus.

Card 41 is named Tessa Totus.

Column 4 includes cards that are contraries of the family identity cards. The individual contrary cards are named by adding the second name 'Contra' to the Mosaic family names. The name Contra is from the Latin contra for "against".

Card 14 is named Serra Contra.

Card 24 is named Para Contra.

Card 34 is named Rota Contra.

Card 44 is named Tessa Contra.

Facilitating a short hand for academic purposes, note that unique initials can identify each card. For example, card 12 Serra Prime can be referred to as SP without confusion with any other card.

Mosaic cards are rich with unique properties not found in other decks of playing-cards. These properties include figure-ground reversibility, handedness, rotational transformation, and perpendicular association.

A useful and unique property of Mosaic playing-cards is that each card face has a reversible base color/suit color. Viewed on a neutral backdrop, the relation of the suit fields composing each card is ambiguous. Either the suit color field or the common base field can be considered as the figure, while the other is considered as the background.

The base color/suit color property provides useful flexibility in game play by allowing the association of the suit color field, the base color field, or both. Referring to the three cards shown in FIG. 5 and FIG. 6, the reversible base color/suit color associations can be observed. The base color field of the center card in FIG. 5 is associated with the base color field of the card to the right to create an arrow shape. In FIG. 6 the same center card is now associated with the left card by associated the suit color fields to create an hourglass shape.

The base color field of the Mosaic suits facilitates the interplay between suits. Referring to FIG. 7, the two cards on the left with horizontal shading represent an alternate Mosaic suit color (such as red). It can be seen that the base color field serves to bridge and bind the different suit colors.

The playing cards of many decks exhibit uniform rotational symmetry; that is, all cards are unchanged by rotating the card 180 degrees. Mosaic playing-cards demonstrate various transformations of character upon rotation. FIG. 8 demonstrates the results of card rotation. FIG. 8 shows the 16-card mosaic set adjacent to identical cards that have been rotated 180 degrees. Various interactions are thereby formed between the card pairs.

Some Mosaic playing-cards demonstrate handedness or persistent directionality. Other cards reverse direction upon rotation. Referring to FIG. 1, row 1 (the Serra family) and row 2 (the Para family), which have parallel diagonal quadrangles, demonstrate handedness. The slope of the diagonals of these cards remains the same upon rotation. Row 3 (the Rota family) and row 4 (the Tessa family), which have intersecting diagonal quadrangles, are said to be ambidextrous. The slope of the diagonals reverses upon card rotation.

Another useful and unique property of Mosaic playing-cards is rotational transformation. Rotating Mosaic cards 180 degrees transforms each card to one of its four relative forms; its reflection, complement, contrary, or identity, according to the properties of each family of related cards. Referring to the rotated pairs shown in FIG. 8 the rotational transformations can be readily observed.

Rotating cards of row 4 (the Tessa family) results in the reflection of the original card. Rotating cards of row 1 (the Serra family) results in the complement of original card. Rotating cards of row 3 (the Rota family) results in the contrary of the original card. Rotating cards of row 2 (the Para family) results in no change from the original or identity card. These rotational variances add depth and richness to Mosaic game play.

Perpendicular association is another useful property of Mosaic cards. Mosaic cards may be oriented vertically, horizontally, or in combinations of orientations. Rotating any pair of related cards ¼ turn results in a shape similar to that created by related pairs of another family. Perpendicular association is an important bridge between the Mosaic families.

FIG. 9 demonstrates that cards of different families can be related through this property of perpendicular association. Each family of cards associates with all pairs of a particular relation, i.e. reflective, complementary, contrary or identical pairs.

Row 1 of FIG. 9 demonstrates the perpendicular association of the Tessa family cards with reflective pairs from all four card families.

Row 2 of FIG. 9 demonstrates the perpendicular association of the Para family cards with complementary pairs from all four card families.

Row 3 of FIG. 9 demonstrates the perpendicular association of the Rota family cards with contrary pairs from all four card families.

Row 4 of FIG. 9 demonstrates the perpendicular association of the Serra family with identical pairs from all four card families.

Each family of cards is said to be the patron of one of these basic relations. The Tessa family is the patron of reflective pairs. The Para family is the patron of complementary pairs. The Rota family is the patron of contrary pairs. The Serra family is the patron of identical pairs.

While many card games can be developed based upon the individual relations and properties of various cards, many other games can be developed based upon combining subsets of related cards. In a traditional deck of cards such subsets would include cards of similar rank, or similar suit, or in a hierarchical sequence.

Mosaic playing-cards are rich with subsets of cards that can be combined to synthesize logical, symmetrical, and attractive complex geometric shapes and patterns. A plurality of games may be developed based upon collecting and arranging these card subsets.

A complete analysis of possible card combinations is beyond the scope of this disclosure. As a starting point for game development and academic analysis, however, several of the more logical and obvious card combinations are presented. The specific goals, and the value of various combinations, are left to the various rules of the individual games.

All the combinations of Mosaic playing-cards are referred to as "mosaics." The simplest logical mosaics are developed based upon family pairs within the 32-card Mosaic suit. These family pairs are referred to as "mosaic couples."

FIGS. 10 to 14 contain two identical 16-card Mosaic sets comprising 32-card Mosaic suits. Pairing the cards according to the basic family relations results in the various mosaic couples. The pairings shown are described in more detail as follows:

FIG. 10 demonstrates the mosaic couples developed from identical pairs.

FIG. 11 demonstrates the mosaic couples developed from reflective pairs.

FIG. 12 demonstrates the mosaic couples developed from complementary pairs.

FIG. 13 demonstrates the mosaic couples developed from contrary pairs.

FIG. 14 demonstrates the mosaic couples developed from identical pairs with one card rotated.

Larger and more complex mosaics can be formed by combining mosaic couples. FIGS. 15 to 18 present examples of various larger combinations that will be useful in the development of many games.

FIG. 15 demonstrates examples of repetitious 4-card mosaics that are referred to as a "mosaic series." A mosaic series consist of three or more cards in a symmetrical sequence that can be continued endlessly. Like links in a chain, the cards at either end of the series can be moved to the opposite end without disrupting the sequence.

FIGS. 16 & 17 demonstrate examples of 8-card mosaics. Rather than a sequence, these combinations represent a geometric pattern. FIG. 18 demonstrates examples of 32-card mosaics derived from the complete Mosaic suit, again demonstrating a geometric pattern.

The reader will appreciate that a naming convention is useful in discussing the ways the playing card can interact. Examples of rotational transformation, perpendicular association, geometric pattern formation, geometric sequence formation, handedness and others have been given. All these concepts will be referred to generally as "geometric interactions." The term "geometric relation" will be understood to more specifically refer to the relation of one card to another. Thus, the term "geometric relations" includes reflection complementarity, contrariety, and identity.

The geometric interactions inherent in the Mosaic deck allow for design of new competitive and amusing games of skill or chance. They are universally understood, thus creating a gaming environment that is trans-cultural. They are inherently simple, allowing for games that can be play be persons of varied intellect, skill, age and experience. The games may be simple or complex depending upon the rules of the games.

Games may be based upon card relations, card properties, collection of sets, shape building, path-forming, pattern development and other interactions. Many additional subtleties, complexities, and variations remain to be explored and exploited as Mosaic gaming develops.

Games types can include, memory games, trick-taking games, outplay games, Poker type wagering games, solitaires, competitive patience games and others. The number of additional games which can be developed is limited only by one's imagination.

EXAMPLE ONE—STUD POKER

Stud Poker is a simple example of a set collection type game. Many of the Mosaic deck's important attributes become evident in the following description of a hypothetical hand of stud Poker:

Mosaic Poker hands are ranked based upon the quantity and quality of cards collected in sets that are geometrically related-as: reflections, complements, contraries, or identities. A ranking values most cards in a series of uniform relations (one card to another).

The second consideration of rank is the suit quality of the series (as in the suit color being red, black, etc.). A flush is best, followed by a combination of suits bridged by the base color field. The least desirable quality is a mixed combination of suits wherein differing suit fields are adjacent in the completed series. Thus, the complete ranking from best to worst can be outlined as follows:

Chain (5 cards)—Flush/Common/Mixed

Run (4 cards)—Flush/Common/Mixed

Full House (Triad+Couplet)

Triad (3 cards)—Flush/Common/Mixed

Couple (2 cards)—Flush/Common/Mixed

Mosaic stud Poker is played with dealing and betting like any stud Poker game that results in 5-card hands being ranked. FIGS. 36 and 37 show two hypothetical hands to be ranked. In this example, the cards in FIG. 36 will be referred to as "Player 1's cards" and the cards in FIG. 37 will be referred to as "Player 2's cards." In each figure, the top row represents the hand as dealt. The middle row represents an intermediate step in organizing the hand. The bottom row represents the final organization of the hand, ready for ranking. Specific cards will be identified by their positions from left to right. The reader should note that two suit colors are present. The dark suit color shown is black. The suit color shown by horizontal hatching is another color, such as red or blue.

In FIG. 36, Player 1 has an obvious identical couple in the 1st and 2nd cards seen in the top row. However, Player 1 can employ several Mosaic card properties to improve his or her hand. Using the property of rotational transformation, Player 1 rotates the 1st card 180 degrees and then associates it with the 2nd card as a complementary couple (see the middle row). Player 1 then employs perpendicular association. He or she rotates the couple formed in the middle row 90 degrees in the counterclockwise direction (see the bottom row). He or she then associates the third card to obtain a triad of identical relations.

In FIG. 37, Player 2 observes the presence of two couples (see the top row). The first couple is created by the 1st and 2nd card having an identical relation. The second couple is created by the 3rd and 4th cards having a reflective relation. Thus, using traditional Poker language, Player 2 holds "two pair." However, using the Mosaic card's properties, this hand can also be improved.

Player 2 couples the 1st and 2nd cards together (see the middle row). Rotating this couple 90 degrees in the counterclockwise direction (see the bottom row) allows the addition of the 3rd card (Note that the 3rd card is associated via the base color field. The 3 card relation thereby formed includes two suit colors). This triad represents the best hand which Player 2 can form. As it includes two suits, Player 2's triad is a "common" triad. Player 1's triad is all of the same suit (a "flush" triad). According to the ranking scheme in this example (and consistent with Poker tradition), Player 1's hand wins.

From this example the reader will perceive how the Mosaic deck can be used to play Poker. The reader will also perceive, however, that the relations possible within the Mosaic deck add a completely new and enriching aspect to the game.

Other traditional Poker games with different rules for dealing and betting can similarly be played in this new geometric game environment. Examples of such games include 7-Card Stud, 5-Card Draw, and Guts, to name a few. It should also be apparent that other set collection games—such as Rummy—can also be played. While the basic structure of these games is unchanged, the geometric relations within the Mosaic deck provide for card properties, probabilities, and strategies that are unique.

The Poker example demonstrates the operation of this method of playing-card play based upon geometric relations including identity, complementarity, contrariety, and reflection. The game operation also includes: rotational transformation, perpendicular association, base color/suit color cross-suit relations, and handedness. As the analysis of the hands in FIGS. 36 and 37 shows, the existence of these properties within the Mosaic deck adds entirely new dimensions to the game of Poker.

The reader should note that sorting and set collection card games are typically played with cards handheld and fanned such that an indexing indicia (recall FIG. 4) reveals the card properties to a player while preventing the player's opponents from seeing those properties. The indexing indicia of the Mosaic cards is therefore a desirable feature in games featuring handheld play.

EXAMPLE TWO—ARRAY

The Mosaic deck can be used to play games in which the object is pattern development. The following example is a geometric pattern game named "Array:"

Array is a competitive game between two players. The object of array is to be the first player to arrange 16 randomly dealt cards into a pattern having both horizontal and vertical axes of symmetry.

The 64 card Mosaic deck is further divided into two equivalent 16 card sets. Further, only two of the four card families are used (in order to simplify the game). For the example shown in FIGS. 38 and 39, only the Para and Tessa families are used. Each set is then dealt face up into an equivalent rectangular array. FIG. 38 shows a random array as dealt. Playing in turn, each player then attempts to reorganize his or her array into one having the aforementioned horizontal and vertical axes of symmetry. Each turn consists of one of the following moves:

Card Swap—The position of any two cards may be swapped.

Block Swap—Any block of two adjacent cards may be swapped for another block of two adjacent cards.

Line Swap—Any two rows or columns may be swapped.

Line Shift—Move a card to the end of a row or column and shift the line of cards to refill the array.

Rotation—Prior to using any of the four options above, any one card may be rotated.

FIG. 39 shows an array which satisfies the criteria of having both horizontal and vertical axes of symmetry. A great number of final patterns are of course possible. Not only can different families be employed, but the ambitious player can employ more than two families of cards. Using all four families (Serra, Para, Rota, and Tessa) obviously makes the game more complex. Additional rules—such as requiring that adjacent card edges match in color—can add even more complexity.

"Array" can also obviously be played as a "solitaire" type game with the score being determined by the number of moves required to complete the array, or a "win or lose" scenario in which only a fixed number of moves are available.

The "Array" game is a good example of how the Mosaic cards can be used to play geometric pattern games which are not possible with emblematic cards.

EXAMPLE THREE—SEQUENCES

The object of Mosaic games can include the development of geometric sequences (as opposed to geometric patterns). A geometric sequence is formed by laying out the cards in a series of repeating relations of three or more cards. The following game—referred to as "Sequences"—demonstrates this operational characteristic:

"Sequences" is a competitive game between two or more players. The object is to meld cards to the table in related sequences. The player to meld all his or her cards first is the winner (All players start with the same number of cards). Scoring could include a one-point penalty per card remaining in the losers' hands. To wager, the players might bet an amount to be paid the winner per card remaining in the losers' hands.

Each player is dealt seven cards. A "start card" is then dealt from the deck onto the table. FIG. 40 shows a typical sequence. The top card in the view is the "start card" dealt first. In turn each player may meld one or more cards to the mosaic to form sequences of relations larger than a couple. Each sequence melded must include at least one card already on the table. The second view from the top in FIG. 40 shows a player having played two cards to create a geometric sequence (In this case, a sequence from left to right).

The third view from the top shows the next player having played two cards to create a geometric sequence extending from top to bottom. The reader should note that this player has altered the suit. In this embodiment, geometric sequences are allowed to extend across suit.

The bottom view shows that the next player has played two cards to create another sequence extending from left to right. Once again, the suit has been changed.

If a player cannot meld to form a sequence, he or she must forfeit a turn and draw three more cards from the deck. The game continues from player to player until one player has laid down all his or her cards.

EXAMPLE FOUR—SQUARES

An object of Mosaic games can include the development of regular geometric shapes, such as squares, triangles, quadrilaterals and the like. The following game—referred to as "Squares"—demonstrates this operational characteristic.

Squares is a competitive game played between two or more players. The object is to lay cards on the table to build square shapes. Scoring is based upon the size and quality of squares developed by each player.

Each player is dealt seven cards. A start card is then dealt from the deck onto the table. In each turn, a player must draw one card from the deck and lay one card down on the table adjacent to one of the previously played cards. Players receive one point for each card they place into each square formed.

The two bottom right pairs shown in FIG. 11 represent the simplest squares that can be formed. The bottom left example in FIG. 16 shows a more complex square made up of eight cards. Much larger squares can, of course, be formed.

Points are doubled for squares that are flush, as well as squares that are symmetrical. The first player to score 32 points wins the game.

These four examples presented (Stud Poker, Array, Sequences, and Squares) serve to illustrate how the Mosaic deck can be used to play a wide variety of games. All these examples employ the "Z-deck" cards described initially in FIG. 1. However, the present invention should certainly not be thought of as being limited to the "Z-deck." The key to the present invention is the fact that the display surface is divided into rectilinear geometric regions. For the "Z-deck," these regions are always four triangles. Many other possibilities exist.

FIG. 24 shows game piece alternate 'X' (78). It has a bisector (48) dividing the display surface into two quadrangles. However, unlike the "Z-deck," each of the quadrangles is then subdivided by two diagonals. This deck is therefore referred to as the "X-deck." Six corners exist on each display surface. These are: first corner (66), second corner (68), third corner (70), fourth corner (72), fifth corner (74), and sixth corner (76).

The upper quadrangle has first diagonal (79) extending from first corner (66) to third corner (70), and second diagonal (80) extending from first corner (66) to third corner (70). The lower quadrangle has third diagonal (81) extending from fourth corner (72) to fifth corner (74), and fourth diagonal (82) extending from sixth corner (76) to third corner (70).

The reader will thereby perceive that the display surface of an "X-deck" card is divided into eight triangles, denoted as first triangle (83), second triangle (84), third triangle (85), fourth triangle (86), fifth triangle (87), sixth triangle (88), seventh triangle (89), and eighth triangle (90).

The lines separating the display surface into the rectilinear geometric regions (the bisector and the four diagonals) do not generally appear on the display surface. The user will only perceive them if the colors of the triangles on opposite sides of a particular line contrast. Thus, the lines themselves are merely "theoretical." In the example shown in FIG. 25, all the colors of adjacent triangles do contrast. Thus, all the lines are visible. For the two cards shown paired on the left side of FIG. 26, however, many of the adjacent triangles have the same color (white).

FIG. 26 actually shows how card couplets can be formed using the "X-deck" cards. FIGS. 27, 28, and 29 illustrate various characteristics which the user will recognize from the detailed description of the "Z-deck." These characteristics include figure-ground reversibility, handedness, rotational transformation, and perpendicular association. Thus, the "X-deck" demonstrates that the interactions of the rectilinear geometric regions described in substantial detail for the "Z-deck" work for other types of rectilinear geometric regions as well.

FIG. 30 shows yet another embodiment, denoted as a "T-deck." Game piece alternate 'T' (92) features a display surface divided by short bisector (93) and long bisector (94). First rectangle (95), second rectangle (96), third rectangle (97), and fourth rectangle (98) are created thereby. Like the "X-deck," the existence of a bisector will only be perceived if the rectangles lying on either side of the bisector have contrasting colors. FIG. 31 shows a case where all adjacent rectangles do have contrasting colors. FIG. 32 shows some cards within the "T-deck" which do not have contrasting adjacent rectangles.

FIGS. 32, 33, 34, and 35 again demonstrate the interactions of the rectilinear geometric regions which are possible for the "T-deck" cards, as for the other examples given.

The reader will thereby appreciate that numerous embodiments featuring display surfaces divided into rectilinear geometric regions are possible. These three embodiments described in detail ("Z-deck," "X-deck," and "T-deck") should therefore not be viewed as limiting the invention's scopes.

Likewise, although most examples have discussed the game pieces as "playing cards," other embodiments are possible. Rigid tiles or domino-like playing pieces can be used for all the games where the pieces must be laid down on a table to form a pattern. Electronic media—such as computer software—can also be substituted for the physical playing pieces.

Although the preceding descriptions have presented substantial detail, they should properly be viewed as providing examples of the present invention rather than any limitation of scope. Accordingly, the scope of the invention should be fixed by the following claims rather than any example given.

Having described my invention, I claim:

1. A method of game play allowing a plurality of users to play a game according to game criteria, comprising:

a. providing a set of opaque contest elements, wherein each contest element within said set includes,
   i. a display surface and a back surface,
   ii. wherein said back surface is identical to every other back surface within said set,
   iii. wherein said display surface is subdivided and differentiated into rectilinear geometric regions with said rectilinear geometric regions extending to the edges of said display surface, and said regions being configured such that when two or more of said contest elements are placed adjacent to each other, geometric interactions spanning said two or more contest elements can be created;
   iv. at least one indexing indicia, positioned on said display surface to allow said at least one indexing indicia to be viewed while exposing a relatively small portion of said display surface, thereby facilitating sorting and manipulation of said contest elements;

b. manipulating said set of contest elements according to said game criteria so that each of said users holds a hand of said opaque contest elements; and c. wherein each of said hands is ranked according to the quantity and quality of geometric interactions present within said contest elements within each of said hands, according to said game criteria.

2. A method as recited in claim 1, wherein:

a. said set of opaque contest elements is subdivided into at least two suits; and b. wherein the consistency of suit is an additional factor in ranking said hands.

3. A method of game play as recited in claim 2, wherein:

a. each of said at least two suits includes a common base color, and a distinctive suit color; and b. said game criteria includes the use of common base color rectilinear geometric regions to extend a geometric interaction from one suit to another suit.

4. A method as recited in claim 1, wherein:

a. each said display surface is divided by a bisector into a first quadrangle and a second quadrangle;

b. each said display surface has a first diagonal dividing said first quadrangle into a first triangle having a color and a second triangle having a color which is different from said color of said first triangle;

c. each said display surface has a second diagonal dividing said second quadrangle into a third triangle having a color and a fourth triangle having a color which is different from said color of said third triangle; and d. said first, second, third, and fourth triangles create said geometric interactions present between said contest elements which are used to rank said hands according to said game criteria.

5. A method as recited in claim 1, wherein:

a. each said display surface is divided by a bisector into a first quadrangle and a second quadrangle;

b. said first quadrangle is bounded by a first corner, a second corner, a third corner, and a fourth corner;

c. said second quadrangle is bounded by said fourth corner, said third corner, a fifth corner, and a sixth corner;

d. said display surface includes a first diagonal, extending from said first corner to said third corner;

e. said display surface includes a second diagonal, extending from said second corner to said fourth corner;

f. said bisector, said first diagonal, and said second diagonal divide said first quadrangle into a first triangle, a second triangle, a third triangle, and a fourth triangle;

g. said display surface includes a third diagonal, extending from said fourth corner to said fifth corner;

h. said display surface includes a fourth diagonal, extending from said third corner to said sixth corner;

i. said bisector, said third diagonal, and said fourth diagonal divide said first quadrangle into a fifth triangle, a sixth triangle, a seventh triangle, and an eighth triangle;

j. said first triangle displays either a base color or a first suit color;

k. said second triangle displays either said base color or said first suit color;

l. said third triangle displays either said base color or said first suit color;

m. said fourth triangle displays either said base color or said first suit color;

n. said fifth triangle displays either said base color or said first suit color;

o. said sixth triangle displays either said base color or said first suit color;

p. said seventh triangle displays either said base color or said first suit color;

q. said eighth triangle displays either said base color or said first suit color; and r. said first, second, third, fourth, fifth, sixth, seventh, and eighth triangles create said geometric interactions present between said contest elements which are used to rank said hands according to said game criteria.

6. A method as recited in claim 1, wherein:

a. each said display surface is divided by a short bisector into a first quadrangle and a second quadrangle;

b. each said display surface is divided by a long bisector, thereby dividing said first quadrangle into a first rectangle and a second rectangle, and said second quadrangle into a third rectangle and a fourth rectangle;

c. said first rectangle displays either a base color or a first suit color;

d. said second rectangle displays either said base color or said first suit color;

e. said third rectangle displays either said base color or said first suit color;

f. said fourth rectangle displays either said base color or said first suit color; and g. said first, second, third, and fourth rectangles create said geometric interactions present between said contest elements which are used to rank said hands according to said game criteria.

7. A method of game play as recited in claim 1, wherein said geometric interactions are selected from the group consisting of reflection, complementarity, contrariety, and identity.

8. A method of game play as recited in claim 1, wherein said geometric interactions are selected from the group consisting of geometric sequences and geometric patterns.

9. A game set, comprising:

a. a predetermined total number of contest elements;

b. each said contest element being opaque;

c. each said contest element having a display surface and a back surface;

d. wherein all of said back surfaces of said contest elements are identical;

e. each said display surface is subdivided and differentiated into rectilinear geometric regions with said rectilinear geometric regions being configured such that when two or more of said contest elements are placed adjacent to each other, geometric interactions spanning said two or more contest elements can be created;

f. wherein each of said contest elements is twice as long as it is wide;

g. wherein each said display surface is divided by a bisector lying at the midpoint of the length of said contest element, thereby dividing said display surface into a first square and a second square;

h. wherein each said display surface has a first diagonal dividing said first square into a first triangle having a color and a second triangle having a color which is different from said color of said first triangle;

i. wherein each said display surface has a second diagonal dividing said second square into a third triangle having a color and a fourth triangle having a color which is different from said color of said third triangle;

j. wherein the combination of said first, second, third, and fourth triangles with said length and said width of said contest elements create said geometric interactions present between said contest elements.

10. A game set as recited in claim 9, wherein said set of opaque contest elements is subdivided into at least two suits.

11. A method of game play as recited in claim 10, wherein:

a. each of said at least two suits includes a common base color, and a distinctive suit color; and b. said game criteria includes the use of common base color rectilinear geometric regions to extend a geometric interaction from one suit to another suit.

12. A game set as recited in claim 9, wherein:

a. said predetermined number of contest elements includes a serra subset;

b. within said serra subset, i. said first triangle and said third triangle are the same color, and ii. said first diagonal and said second diagonal are parallel.

13. A game set as recited in claim 9, wherein:

a. said predetermined number of contest elements includes a para subset;

b. within said para subset, i. said first triangle and said third triangle are not the same color, and ii. said first diagonal and said second diagonal are parallel.

14. A game set as recited in claim 9, wherein:

a. said predetermined number of contest elements includes a rota subset;

b. within said rota subset, i. said first triangle and said third triangle are not the same color, and ii. said first diagonal and said second diagonal are not parallel.

15. A game set as recited in claim 9, wherein:

a. said predetermined number of contest elements includes a tessa subset;

b. within said tessa subset, i. said first triangle and said third triangle are the same color, and ii. said first diagonal and said second diagonal are not parallel.

16. A game set as recited in claim 9, wherein:

a. said predetermined number of contest elements are subdivided into a plurality of subsets; and b. said plurality of subsets are selected from the group consisting of a serra subset, a para subset, a rota subset, and a tessa subset.

17. A game set as recited in claim 16, wherein each of said subsets is further subdivided into at least two suits.

18. A method of game play as recited in claim 17, wherein:

a. each of said at least two suits includes a common base color, and a distinctive suit color; and b. said game criteria includes the use of common base color rectilinear geometric regions to extend a geometric interaction from one suit to another suit.

19. A game set comprising:

a. a predetermined total number of contest elements;

b. each said contest element being opaque;

c. each said contest element having a display surface and a back surface;

d. wherein all of said back surfaces of said contest elements are identical;

e. each said display surface is subdivided and differentiated into rectilinear geometric regions with said rectilinear geometric regions being configured such that when two or more of said contest elements are placed adjacent to each other, geometric interactions spanning said two or more contest elements can be created;

f. wherein each of said contest elements is twice as long as it is wide;

g. wherein each said display surface is divided by a bisector into a first square and a second square;

h. wherein said first square is bounded by a first corner, a second corner, a third corner, and a fourth corner;

i. wherein said second square is bounded by said fourth corner, said third corner, a fifth corner, and a sixth corner;

j. wherein said display surface includes a first diagonal, extending from said first corner to said third corner;

k. wherein said display surface includes a second diagonal, extending from said second corner to said fourth corner;

l. wherein said bisector, said first diagonal, and said second diagonal divide said first square into a first triangle, a second triangle, a third triangle, and a fourth triangle;

m. wherein said display surface includes a third diagonal, extending from said fourth corner to said fifth corner;

n. wherein said display surface includes a fourth diagonal, extending from said third corner to said sixth corner;

o. wherein said bisector, said third diagonal, and said fourth diagonal divide said second square into a fifth triangle, a sixth triangle, a seventh triangle, and an eighth triangle;

p. wherein said first triangle displays either a base color or a first suit color;

q. wherein said second triangle displays either said base color or said first suit color;

r. wherein said third triangle displays either said base color or said first suit color;

s. wherein said fourth triangle displays either said base color or said first suit color;

t. wherein said fifth triangle displays either said base color or said first suit color;

u. wherein said sixth triangle displays either said base color or said first suit color;

v. wherein said seventh triangle displays either said base color or said first suit color;

w. wherein said eighth triangle displays either said base color or said first suit color; and x. wherein the combination of said first, second, third, fourth, fifth, sixth, seventh, and eighth triangles with said length and said width of said contest elements create said geometric interactions present between said contest elements.

20. A game set as recited in claim 19, wherein said set of opaque contest elements is subdivided into at least two suits.

21. A method of game play as recited in claim 20, wherein:

a. each of said at least two suits includes a common base color, and a distinctive suit color; and b. said game criteria includes the use of common base color rectilinear geometric regions to extend a geometric interaction from one suit to another suit.

22. A game set, comprising:

a. a predetermined total number of contest elements;

b. each said contest element being opaque;

c. each said contest element having a display surface and a back surface;

d. wherein all of said back surfaces of said contest elements are identical;

e. each said display surface is subdivided and differentiated into rectilinear geometric regions with said rectilinear geometric regions being configured such that when two or more of said contest elements are placed adjacent to each other, geometric interactions spanning said two or more contest elements can be created;

f. wherein each of said contest elements is twice as long as it is wide;

g. wherein each said display surface is divided by a short bisector into a first square and a second square;

h. wherein each said display surface is divided by a long bisector, thereby dividing said first square into a first rectangle and a second rectangle, and said second square into a third rectangle and a fourth rectangle;

i. wherein said first rectangle displays either a base color or a first suit color;

j. wherein said second rectangle displays either said base color or said first suit color;

k. wherein said third rectangle displays either said base color or said first suit color;

l. wherein said fourth rectangle displays either said base color or said first suit color; and m. wherein the combination of said first, second, third, and fourth rectangles with said length and said width of said contest elements create said geometric interactions present between said contest elements which are used to rank said hands according to said game criteria.

23. A game set as recited in claim 22, wherein said set of opaque contest elements is subdivided into at least two suits.

24. A method of game play as recited in claim 23, wherein:

a. each of said at least two suits includes a common base color, and a distinctive suit color; and b. said game criteria includes the use of common base color rectilinear geometric regions to extend a geometric interaction from one suit to another suit.

25. A method of game play allowing a plurality of users to play a game according to game criteria, comprising:

a. providing a set of opaque contest elements, wherein each contest element within said set includes, i. a display surface and a back surface, ii. wherein said back surface is identical to every other back surface within said set, iii. wherein said display surface is differentiated into rectilinear geometric regions with said rectilinear geometric regions extending to the edges of said display surface, and said regions being configured such that when two or more of said contest elements are placed adjacent to each other, geometric interactions spanning said two or more contest elements can be created;

b. manipulating said set of contest elements according to said game criteria so that each of said users holds a hand of said opaque contest elements; and c. wherein each of said hands is ranked according to the quantity and quality of geometric interactions present within said contest elements within each of said hands, according to said game criteria; and d. each said display surface is divided by a bisector into a first quadrangle and a second quadrangle;

e. each said display surface has a first diagonal dividing said first quadrangle into a first triangle having a color and a second triangle having a color which is different from said color of said first triangle;

f. each said display surface has a second diagonal dividing said second quadrangle into a third triangle having a color and a fourth triangle having a color which is different from said color of said third triangle; and g. said first, second, third, and fourth triangles create said geometric interactions present between said contest elements which are used to rank said hands according to said game criteria.

26. A method of game play as recited in claim 25, wherein said geometric interactions used to rank said hands are selected from the group consisting of reflection, complementarity, contrariety, and identity.

27. A method of game play as recited in claim 25, wherein said geometric interactions used to rank said hands comprise geometric sets of a plurality of related contest elements.

28. A method of game play as recited in claim 25, wherein said geometric interactions used to rank said hands comprise geometric sequences.

29. A method of game play as recited in claim 25, wherein said geometric interactions used to rank said hands comprise geometric patterns.

30. A method as recited in claim 25, wherein:

a. said set of opaque contest elements is subdivided into at least two suits; and b. wherein the consistency of suit is an additional factor in ranking said hands.

31. A method of game play as recited in claim 30, wherein:

a. each of said at least two suits includes a common base color, and a distinctive suit color; and b. said game criteria includes the use of common base color rectilinear geometric regions to extend a geometric interaction from one suit to another suit.

32. A method as recited in claim 25, wherein:

a. each said display surface is divided by a short bisector into a first quadrangle and a second quadrangle;

b. each said display surface is divided by a long bisector, thereby dividing said first quadrangle into a first rectangle and a second rectangle, and said second quadrangle into a third rectangle and a fourth rectangle;

c. said first rectangle displays either a base color or a first suit color;

d. said second rectangle displays either said base color or said first suit color;

e. said third rectangle displays either said base color or said first suit color;

f. said fourth rectangle displays either said base color or said first suit color; and g. said first, second, third, and fourth rectangles create said geometric interactions present between said contest elements which are used to rank said hands according to said game criteria.

33. A method of game play allowing a plurality of users to play a game according to game criteria, comprising:

a. providing a set of opaque contest elements, wherein each contest element within said set includes, i. a display surface and a back surface, ii. wherein said back surface is identical to every other back surface within said set, iii. wherein said display surface is differentiated into rectilinear geometric regions with said rectilinear geometric regions extending to the edges of said display surface, and said regions being configured such that when two or more of said contest elements are placed adjacent to each other, geometric interactions spanning said two or more contest elements can be created;

b. manipulating said set of contest elements according to said game criteria so that each of said users holds a hand of said opaque contest elements; and c. wherein each of said hands is ranked according to the quantity and quality of geometric interactions present within said contest elements within each of said hands, according to said game criteria;

d. wherein each said display surface is divided by a bisector into a first quadrangle and a second quadrangle;

e. wherein said first quadrangle is bounded by a first corner, a second corner, a third corner, and a fourth corner;

f. wherein said second quadrangle is bounded by said fourth corner, said third corner, a fifth corner, and a sixth corner;

g. wherein said display surface includes a first diagonal, extending from said first corner to said third corner;

h. wherein said display surface includes a second diagonal, extending from said second corner to said fourth corner;

i. wherein said bisector, said first diagonal, and said second diagonal divide said first quadrangle into a first triangle, a second triangle, a third triangle, and a fourth triangle;

j. wherein said display surface includes a third diagonal, extending from said fourth corner to said fifth corner;

k. wherein said display surface includes a fourth diagonal, extending from said third corner to said sixth corner;

l. wherein said bisector, said third diagonal, and said fourth diagonal divide said first quadrangle into a fifth triangle, a sixth triangle, a seventh triangle, and an eighth triangle;

m. wherein said first triangle displays either a base color or a first suit color;

n. wherein said second triangle displays either said base color or said first suit color;

o. wherein said third triangle displays either said base color or said first suit color;

p. wherein said fourth triangle displays either said base color or said first suit color;

q. wherein said fifth triangle displays either said base color or said first suit color;

r. wherein said sixth triangle displays either said base color or said first suit color;

s. wherein said seventh triangle displays either said base color or said first suit color;

t. wherein said eighth triangle displays either said base color or said first suit color; and u. wherein said first, second, third, fourth, fifth, sixth, seventh, and eighth triangles create said geometric interactions present between said contest elements which are used to rank said hands according to said game criteria.

34. A method of game play allowing at least one user to play a game according to game criteria, comprising:

a. providing a set of opaque contest elements, wherein each contest element within said set includes, i. a display surface and a back surface, ii. wherein said back surface is identical to every other back surface within said set, iii. wherein said display surface is differentiated into rectilinear geometric regions, with said rectilinear geometric regions being located and oriented so that the placement of one of said contest elements adjacent to another of said contest elements can form a geometric interaction;

b. manipulating said set of contest elements according to said game criteria;

c. wherein a result of said game play is determined by the quantity and quality of geometric interactions present;

d. wherein each said display surface is divided by a bisector into a first quadrangle and a second quadrangle;

e. wherein each said display surface has a first diagonal dividing said first quadrangle into a first triangle having a color and a second triangle having a color which is different from said color of said first triangle;

f. wherein each said display surface has a second diagonal dividing said second quadrangle into a third triangle having a color and a fourth triangle having a color which is different from said color of said third triangle; and g. wherein said first, second, third, and fourth triangles create said geometric interactions present between said contest elements which are used to rank said hands according to said game criteria.

35. A method of game play as recited in claim 34, wherein said geometric interactions are selected from the group consisting of must include reflection, complementarity, contrariety, and identity.

36. A method of game play as recited in claim 34, wherein said geometric interactions comprise geometric sequences.

37. A method of game play as recited in claim 34, wherein said geometric interactions comprise geometric patterns.

38. A method as recited in claim 34, wherein:

a. said set of opaque contest elements is subdivided into at least two suits; and b. wherein the consistency of suit is an additional factor in said result of said game play.

39. A method of game play as recited in claim 38, wherein:

a. each of said at least two suits includes a common base color, and a distinctive suit color; and b. said game criteria includes the use of common base color rectilinear geometric regions to extend a geometric interaction from one suit to another suit.

40. A method of game play allowing at least one user to play a game according to game criteria, comprising:

a. providing a set of opaque contest elements, wherein each contest element within said set includes, i. a display surface and a back surface, ii. wherein said back surface is identical to every other back surface within said set, iii. wherein said display surface is differentiated into rectilinear geometric regions, with said rectilinear geometric regions being located and oriented so that the placement of one of said contest elements adjacent to another of said contest elements can form a geometric interaction;

b. manipulating said set of contest elements according to said game criteria;

c. wherein a result of said game play is determined by the quantity and quality of geometric interactions present;

d. wherein each said display surface is divided by a bisector into a first quadrangle and a second quadrangle;

e. wherein said first quadrangle is bounded by a first corner, a second corner, a third corner, and a fourth corner;

f. wherein said second quadrangle is bounded by said fourth corner, said third corner, a fifth corner, and a sixth corner;

g. wherein said display surface includes a first diagonal, extending from said first corner to said third corner;

h. wherein said display surface includes a second diagonal, extending from said second corner to said fourth corner;

i. wherein said bisector, said first diagonal, and said second diagonal divide said first quadrangle into a first triangle, a second triangle, a third triangle, and a fourth triangle;

j. wherein said display surface includes a third diagonal, extending from said fourth corner to said fifth corner;

k. wherein said display surface includes a fourth diagonal, extending from said third corner to said sixth corner;

l. wherein said bisector, said third diagonal, and said fourth diagonal divide said first quadrangle into a fifth triangle, a sixth triangle, a seventh triangle, and an eighth triangle;

m. wherein said first triangle displays either a base color or a first suit color;

n. wherein said second triangle displays either said base color or said first suit color;

o. wherein said third triangle displays either said base color or said first suit color;

p. wherein said fourth triangle displays either said base color or said first suit color;

q. wherein said fifth triangle displays either said base color or said first suit color;

r. wherein said sixth triangle displays either said base color or said first suit color;

s. wherein said seventh triangle displays either said base color or said first suit color;

t. wherein said eighth triangle displays either said base color or said first suit color; and u. wherein said first, second, third, fourth, fifth, sixth, seventh, and eighth triangles create said geometric interactions present between said contest elements which are used to rank said hands according to said game criteria.

41. A method of game play allowing at least one user to play a game according to game criteria, comprising:

a. providing a set of opaque contest elements, wherein each contest element within said set includes, i. a display surface and a back surface, ii. wherein said back surface is identical to every other back surface within said set, iii. wherein said display surface is differentiated into rectilinear geometric regions, with said rectilinear geometric regions being located and oriented so that the placement of one of said contest elements adjacent to another of said contest elements can form a geometric interaction;

b. manipulating said set of contest elements according to said game criteria;

c. wherein a result of said game play is determined by the quantity and quality of geometric interactions present;

d. each said display surface is divided by a short bisector into a first quadrangle and a second quadrangle;

e. each said display surface is divided by a long bisector, thereby dividing said first quadrangle into a first rectangle and a second rectangle, and said second quadrangle into a third rectangle and a fourth rectangle;

f. said first rectangle displays either a base color or a first suit color;

g. said second rectangle displays either said base color or said first suit color;

h. said third rectangle displays either said base color or said first suit color;

i. said fourth rectangle displays either said base color or said first suit color; and j. said first, second, third, and fourth rectangles create said geometric interactions present between said contest elements which are used to rank said hands according to said game criteria.

* * * * *